US006891452B2

(12) United States Patent
Mikami et al.

(10) Patent No.: US 6,891,452 B2
(45) Date of Patent: May 10, 2005

(54) HIGH-FREQUENCY CIRCUIT DEVICE AND TRANSMITTER/RECEIVER

(75) Inventors: Shigeyuki Mikami, Yokohama (JP); Tetsuya Kouchi, deceased, late of Sagamihara (JP); by Kiyoharu Kochi, legal representative, Ehime-ken (JP); by Akiko Kochi, legal representative, Ehime-ken (JP); Hiroyasu Matsuzaki, Yokohama (JP); Kazutaka Mukaiyama, Sagamihara (JP); Koichi Sakamoto, Yokohama (JP); Yohei Ishikawa, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 73 days.

(21) Appl. No.: 10/373,091

(22) Filed: Feb. 26, 2003

(65) Prior Publication Data

US 2004/0041668 A1 Mar. 4, 2004

(30) Foreign Application Priority Data

Feb. 26, 2002 (JP) ..... 2002-050082

(51) Int. Cl.[7] ..... H01P 1/203
(52) U.S. Cl. ..... 333/219; 333/204; 333/219.1
(58) Field of Search ..... 333/219, 219.1, 333/202, 204

(56) References Cited

U.S. PATENT DOCUMENTS 4,063,201 A * 12/1977 Komatsubara et al. ..... 333/168
5,892,668 A * 4/1999 Okamoto et al. ..... 363/40
5,974,335 A 10/1999 Talisa et al.
6,384,705 B1 * 5/2002 Huang et al. ..... 336/200
6,653,917 B2 * 11/2003 Kang et al. ..... 333/99 S
6,700,459 B2 * 3/2004 Raihn et al. ..... 333/99 S

FOREIGN PATENT DOCUMENTS

| | | |
|---|---|---|
| EP | 1 058 335 A2 | 12/2000 |
| EP | 1 126 540 A2 | 8/2001 |
| JP | 2000-101301 | 4/2000 |
| WO | WO 99/56338 | 11/1999 |

* cited by examiner

*Primary Examiner*—Dinh T. Le
(74) *Attorney, Agent, or Firm*—Dickstein, Shapiro, Morin & Oshinsky, LLP.

(57) ABSTRACT

A high-frequency circuit device includes a dielectric substrate. A planar conductor is provided on each of top and bottom surfaces of the dielectric substrate and a slot line is formed on the top surface. Also, undesired-wave propagation preventing circuits, each including multistage band-elimination filters, are provided on the top surface of the dielectric substrate, with the slot line therebetween. Each of the band-elimination filters includes two conductive lines and a resonator which is provided at a portion of one of the conductive lines and which includes two spiral lines. Accordingly, propagation of an undesired wave of the band whose center is the resonance frequency of the resonator can be prevented.

13 Claims, 22 Drawing Sheets

HIGH-FREQUENCY CIRCUIT DEVICE AND TRANSMITTER/RECEIVER

BACKGROUND OF THE INVENTION

1. Field of the Invention

The present invention relates to a high-frequency circuit device including two parallel planar conductors, such as a waveguide or a resonator, and to a transmitter/receiver including the same.

2. Description of the Related Art

In general, as high-frequency circuit devices using high-frequency signals, such as microwaves and millimeter waves, the following various transmission lines have been known: a grounded coplanar transmission line, in which a ground electrode is formed on the bottom surface of a dielectric plate and a coplanar is formed on the top surface thereof; a grounded slot transmission line, in which a ground electrode is formed on the bottom surface of a dielectric plate and a slot is formed on the top surface thereof; and a Planar Dielectric Transmission Line (hereinafter referred to as a PDTL), in which slots are formed on both principal surfaces of a dielectric plate such that the slots face each other.

Each of these transmission lines includes two planar conductors which are parallel to each other. Thus, if an electromagnetic field is disturbed at the input/output unit or a bend of the transmission line, an undesired wave of a spurious mode, such as a so-called parallel plate mode, may be generated between the two parallel planar conductors. Accordingly, the undesired wave propagates between the planar conductors and interference of undesired wave may be caused between adjoining transmission lines, whereby leakage of a signal may be disadvantageously caused.

In order to prevent propagation of such an undesired wave, a spurious-mode propagation preventing circuit (for example, disclosed in Japanese Unexamined Patent Application Publication No. 2000-101301) has been known. In this circuit, an electrode is provided on a planar conductor formed on the top surface of a dielectric plate, the electrode generating capacitance between planar conductors on the top and bottom surfaces. Also, a conductive pattern which is connected to the electrode so as to form an inductor and which includes a plurality of lines is provided.

In the above-described known art, the conductive pattern including the electrode and the lines is formed on the planar conductor on the top surface of the dielectric plate and the capacitance of the electrode and the inductance of the lines are combined so as to form a low-pass filter so that propagation of an undesired wave can be prevented. However, in the known art, the capacitance of the electrode or the inductance of the lines must be increased as the frequency of the undesired wave decreases.

At this time, the electrode generates a capacitance between the electrode and the planar conductor on the bottom surface. Thus, the area of the electrode must be increased in order to increase the capacitance. On the other hand, in order to increase the inductance, the width of each line should be decreased or the length of each line should be increased. Since the width of the line is limited by the manufacturing precision, the length of the line must be increased in order to increase the inductance.

Accordingly, in the known art, the area of the conductive pattern is likely to increase, and thus the size of the entire dielectric plate increases and the manufacturing cost also increases.

SUMMARY OF THE INVENTION

The present invention has been made in view of the above-described problems in the known art, and an object of the present invention is to provide a miniaturized high-frequency circuit device which can prevent propagation of an undesired wave, and to provide a transmitter/receiver including the same.

In order to solve the above-described problems, the present invention is applied to a high-frequency circuit device comprising at least two planar conductors which are parallel to each other; and an undesired-wave propagation preventing circuit which is provided in at least one of the two planar conductors and which is coupled with an undesired wave propagating between the two planar conductors so as to block propagation of the undesired wave.

The undesired-wave propagation preventing circuit includes multistage band-elimination filters. The band-elimination filter in each stage includes two conductive lines which are mutually connected at an interstage and a resonator provided at a predetermined portion of at least one of the two conductive lines, said resonator including two spiral lines extending in parallel and forming a spiral shape, ends of the two spiral lines being connected.

With this configuration, a hairpin resonator can be formed by connecting the heads of the two spiral lines. The resonator can equivalently form a parallel resonance circuit, in which the capacitance generated between the two spiral lines and the inductance of each branch line are connected in parallel. Accordingly, propagation of an undesired wave can be blocked at the band in the vicinity of the resonance frequency of the resonator.

Also, since the resonator is formed by using the two spiral lines, the resonator can be miniaturized and the magnetic field can be concentrated to the center of the spiral. Accordingly, effects of other circuits can be eliminated and an undesired wave can be blocked.

Preferably, the width of each of the spiral lines is set to the same value along the entire length thereof and the gap between the two spiral lines is set to the same value along the entire length thereof.

By setting the width of each line and the gap between the lines to a small value, the capacitance and the inductance of the resonator can be increased, and the frequency band of an undesired wave which can be blocked can be decreased while miniaturizing the resonator.

The width of each of the spiral lines may be larger at the center of the spiral than at the periphery of the spiral.

With this arrangement, the width of each spiral line is large at the center of the spiral, where the strength of the magnetic field is large. Thus, concentration of current can be alleviated and the nonloaded Q of the resonator can be improved so as to reduce loss of the resonator.

The gap between the two spiral lines may be larger at the center of the spiral than at the periphery of the spiral.

With this arrangement, the gap between the two spiral lines is large at the center of the spiral, where the strength of the magnetic field is large. Thus, concentration of current can be alleviated and the nonloaded Q of the resonator can be improved so as to reduce loss of the resonator.

Each resonator forming the band-elimination filter of each stage may be provided in one of the two conductive lines.

With this arrangement, when an undesired wave propagates between the two conductive lines, the undesired wave can be blocked by the resonator, which is provided in one of the two conductive lines in each stage.

The resonators forming the band-elimination filters of adjacent stages are arranged at a different conducive line to each other of the two conductive lines.

With this arrangement, the resonators can be placed in a staggered pattern to the two conductive lines. Accordingly, when an undesired wave propagates between the two conductive lines, the undesired wave can be blocked by the resonators, which are placed in a staggered pattern.

Each resonator forming the band-elimination filter of each stage may be provided in each of the two conductive lines.

With this arrangement, when an undesired wave propagates between the two conductive lines, the undesired wave can be blocked by the resonator, which is provided in each of the two conductive lines. In particular, since two resonators can be connected to the band-elimination filter in each stage, the number of resonators connected to the conductive lines can be increased. Therefore, an undesired wave can be blocked more reliably and the band of an undesired wave which can be blocked can be broadened.

The gap between the two spiral lines may be set at 1/10 or less of the distance between the two planar conductors.

With this arrangement, the capacitance generated between the two spiral lines can be made to be larger than the capacitance generated between the two planar conductors. Thus, the resonance frequency of the resonator can be easily decreased compared to the case where the capacitance generated between the planar conductors is used. Accordingly, the resonator can be miniaturized. Also, the resonance frequency of the resonator can be decreased by decreasing the gap between the two spiral lines and the resonance frequency of the resonator can be increased by decreasing the length of the spiral lines. Therefore, when an undesired wave of the same frequency is blocked, the band-elimination filter including the resonator can be miniaturized compared to the conductive pattern forming the low-pass filter of the known art, and thus the undesired-wave propagation preventing circuit can be miniaturized.

Further, a transmitter/receiver can be formed by using the high-frequency circuit device according to the present invention. Accordingly, the undesired-wave propagation preventing circuit can be provided on the dielectric substrate of the transmitter/receiver so that an undesired wave propagating in the dielectric substrate can be blocked. As a result, power loss due to an undesired wave can be suppressed so as to improve efficiency, and noise caused by the undesired wave can be reduced.

A high-frequency circuit device of the present invention includes at least two planar conductors which are parallel to each other; and an undesired-wave propagation preventing circuit which is provided in at least one of the two planar conductors and which is coupled with an undesired wave propagating between the two planar conductors so as to block propagation of the undesired wave, wherein the undesired-wave propagation preventing circuit includes multistage band-elimination filters, and the band-elimination filter in each stage includes two conductive lines which are mutually connected at an interstage and a resonator including a first spiral extending from one of said two conductive lines, and a second spiral extending from an end of the first spiral and being parallel to the first spiral.

Further, the band elimination filter at each stage including the two conductive lines and said resonator may be connected diagonally.

The band elimination filter at each stage may include the resonator provided at each of the two conductive lines, and the respective resonator is arranged alternately from different directions to each other.

The band elimination filter at each stage may include the resonator provided at each of the two conductive lines, and the respective resonator is arranged side by side.

DESCRIPTION OF THE PREFERRED EMBODIMENTS

Figure 1:
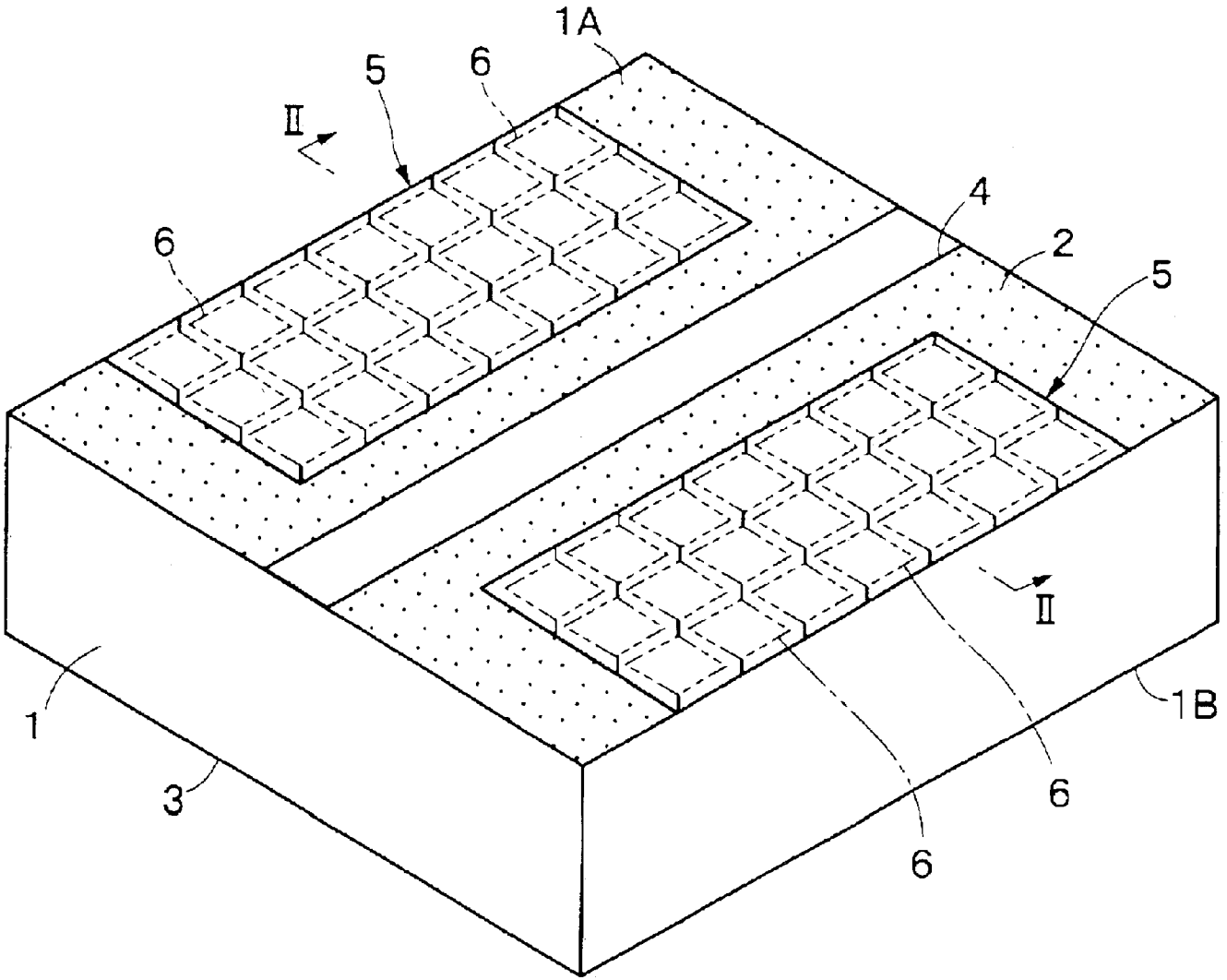
FIG. 1 is a perspective view showing a high-frequency circuit device according to a first embodiment of the present invention.
Figure 2:
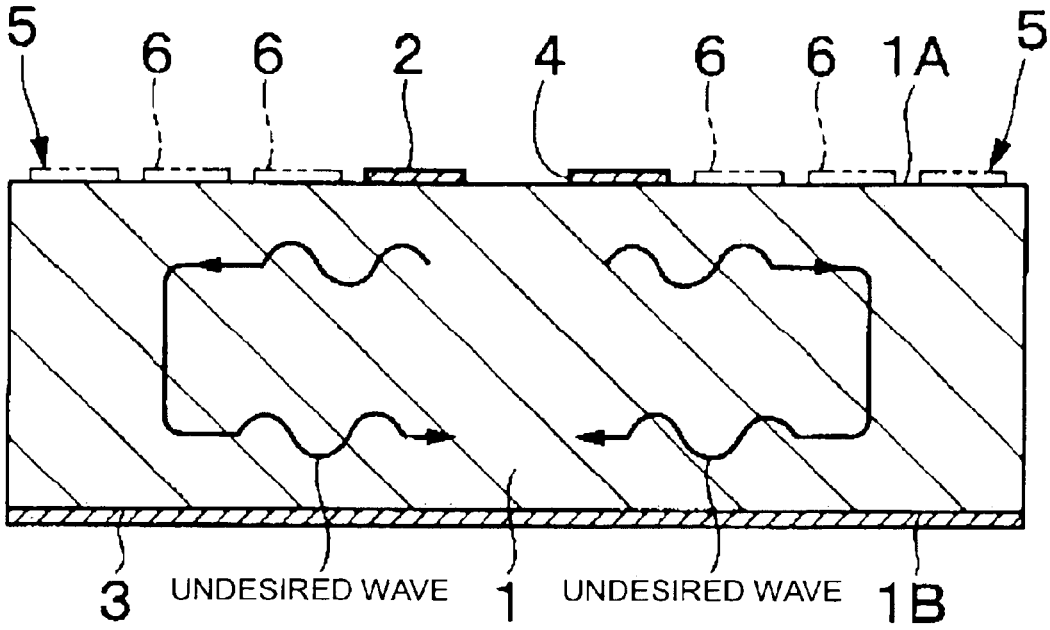
FIG. 2 is a cross-sectional view taken along the line II—II of FIG. 1.
Figure 3:
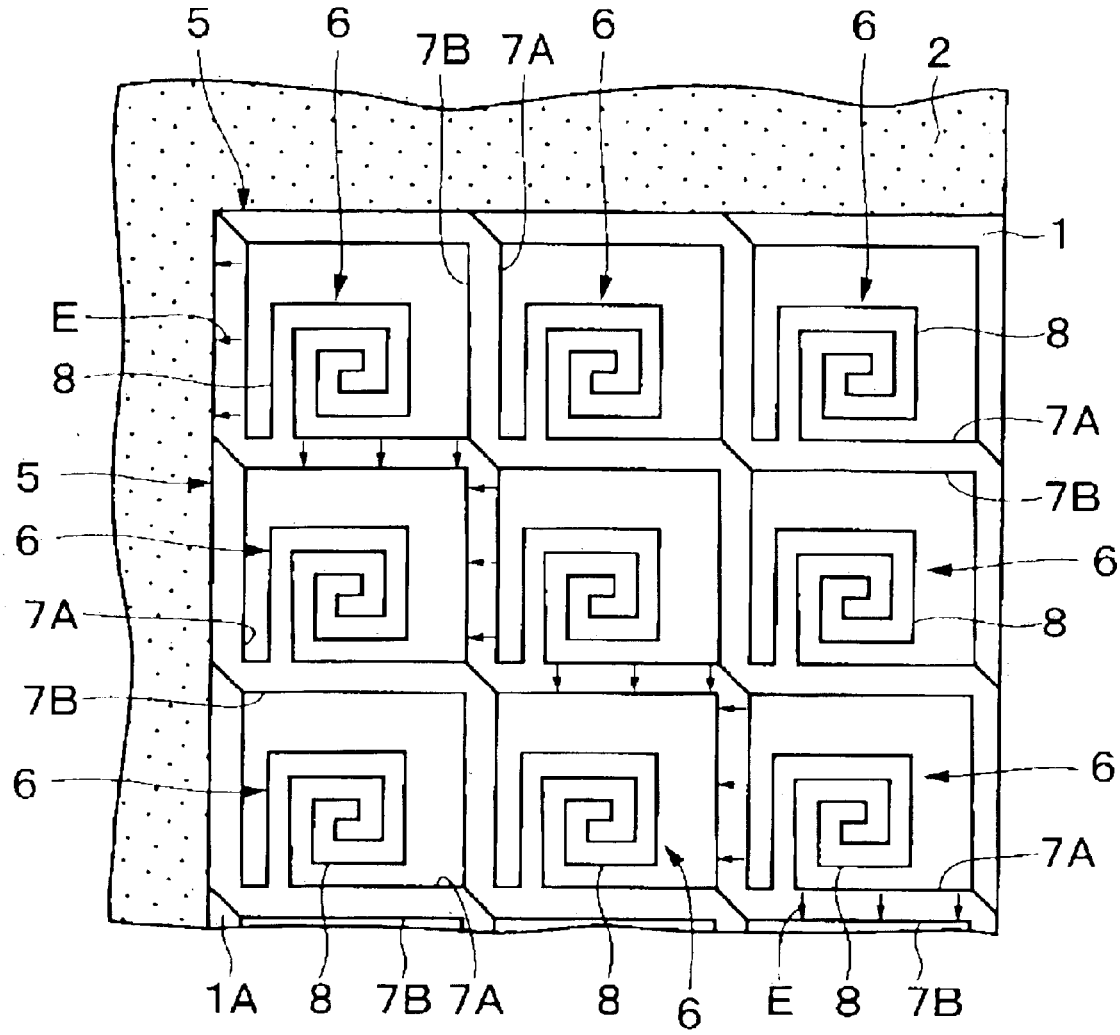
FIG. 3 is an enlarged plan view showing the critical portion of an undesired-wave propagation preventing circuit shown in FIG. 1.

Hereinafter, a high-frequency circuit device according to embodiments of the present invention will be described with reference to the attached drawings.

FIGS. 1 to 11 show a first embodiment. In the figures, a dielectric substrate 1 comprises a resin material, a ceramic material, or a composite material prepared by mixing resin and ceramic materials and by sintering the mixed material. The dielectric substrate 1 is a flat plate having a relative permittivity $\in r$ of about 24 and a thickness T of about 0.6 mm. A planar conductor 2 is formed on a top surface 1A of the dielectric substrate 1 and a planar conductor 3 is formed on a bottom surface 1B of the dielectric substrate 1, the planar conductor 3 serving as a ground electrode. Each of the planar conductors 2 and 3 comprises a conductive metallic thin-film having a thickness of about 1 to 3 $\mu$m. Also, the planar conductors 2 and 3 cover the substantially entire area of the top surface 1A and the bottom surface 1B of the dielectric substrate 1, respectively.

A slot line 4 is used as a circuit for exciting high-frequency electromagnetic waves (high-frequency signals), such as microwaves and millimeter waves. The slot line 4 includes a groove-like opening extending in the longitudinal direction of the planar conductor 2. The slot line 4 faces the planar conductor 3, serving as a ground electrode, so as to serve as a grounded slot line.

Figure 4:
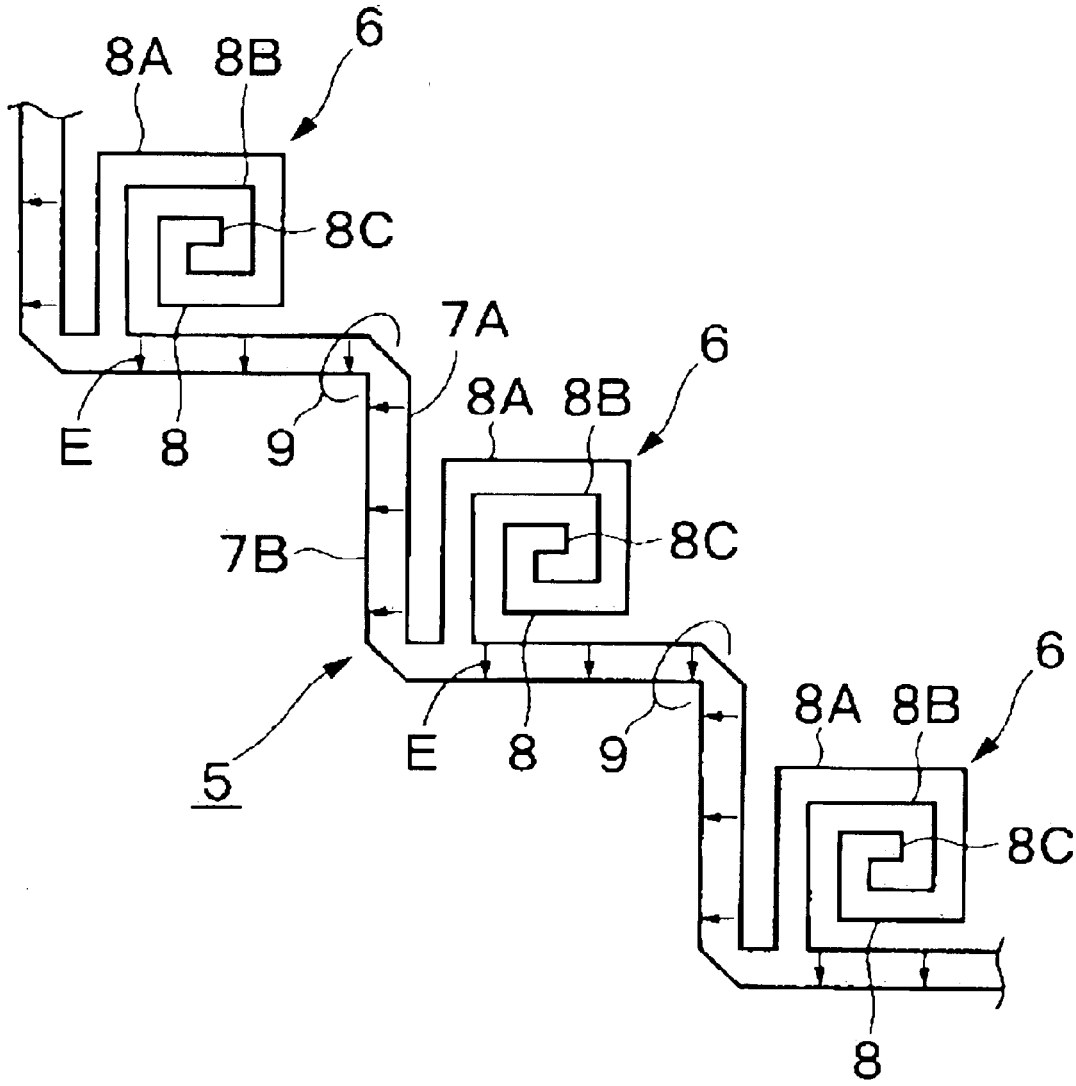
FIG. 4 is an enlarged plan view showing the critical portion of single undesired-wave propagation preventing circuit shown in FIG. 3.

Undesired-wave propagation preventing circuits 5 are provided in the right and left sides of the planar conductor 2, with the slot line 4 therebetween. Each of the undesired-wave propagation preventing circuits 5 is formed by coupling multistage band-elimination filters 6, which will be described later, so as to be formed in a substantially band-shape, as shown in FIG. 4. A plurality of band-elimination filters 6 are placed on the top surface of the dielectric substrate 1 such that the filters 6 adjoin and contact each other, whereby a substantially rectangular plane is formed.

Each of the band-elimination filters 6, forming the undesired-wave propagation preventing circuit 5, includes two conductive lines 7A and 7B, which are mutually connected at an interstage, and a resonator 8 provided at a portion of the conductive line 7A. The band-elimination filters 6 are provided on the top surface 1A of the dielectric substrate 1 in a meshed pattern, and are staggered in a slanting direction with respect to the direction parallel to the slot line 4 and are coupled in the vertical direction.

Also, each of the two conductive lines 7A and 7B is formed by a thin line comprising a conductive metallic material, which is also used for the planar conductor 2. The base ends of the conductive lines 7A and 7B are connected to the planar conductor 2. Further, the conductive lines 7A and 7B are open in any of front, back, right, and left sides of the dielectric substrate 1. Accordingly, an undesired wave having an electric field E propagating between the conductive lines 7A and 7B is led to one of the resonators 8 placed in a meshed pattern.

Herein, the resonator 8 is provided at a predetermined portion of the conductive line 7A and includes two spiral lines 8A and 8B, which extend in parallel to each other and form a rectangular spiral. Each of the spiral lines 8A and 8B is formed by a thin line comprising a conductive metallic material, as in the conductive line 7A. The width W of each of the spiral lines 8A and 8B is set to the same value along the entire length thereof, and also the gap S between the two spiral lines 8A and 8B is set to the same value along the entire length thereof. The width W and the gap S is set to about 1 to 10 $\mu$m. Accordingly, the gap S is set to a value of 1/10 or less of the thickness T of the dielectric substrate 1, that is, the space between the two planar conductors 2 and 3 ($S \leqq T/10$).

Figure 8:
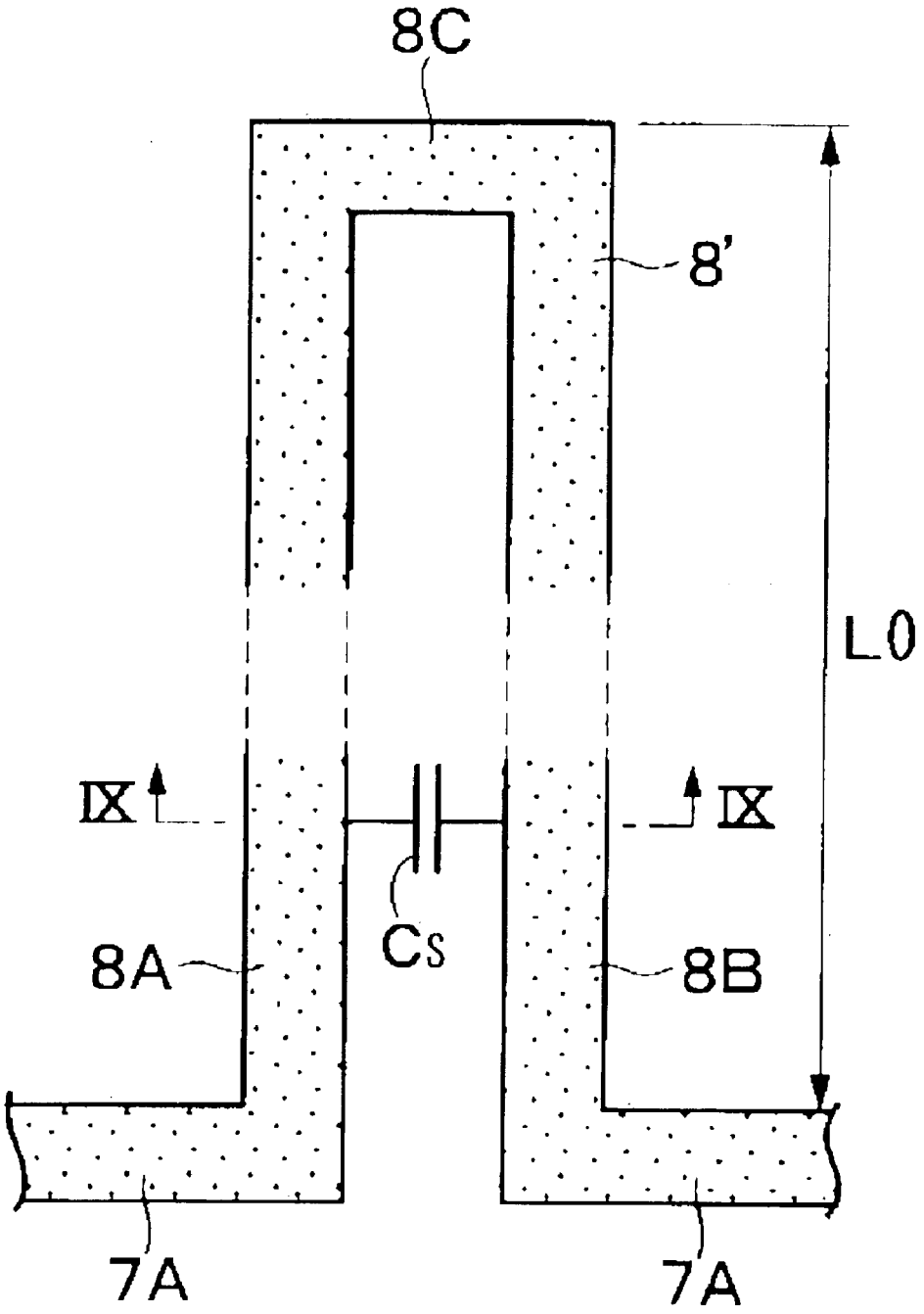
FIG. 8 is a plan view showing a hairpin resonator which is equivalent to the resonator shown in FIG. 6.
Figure 9:
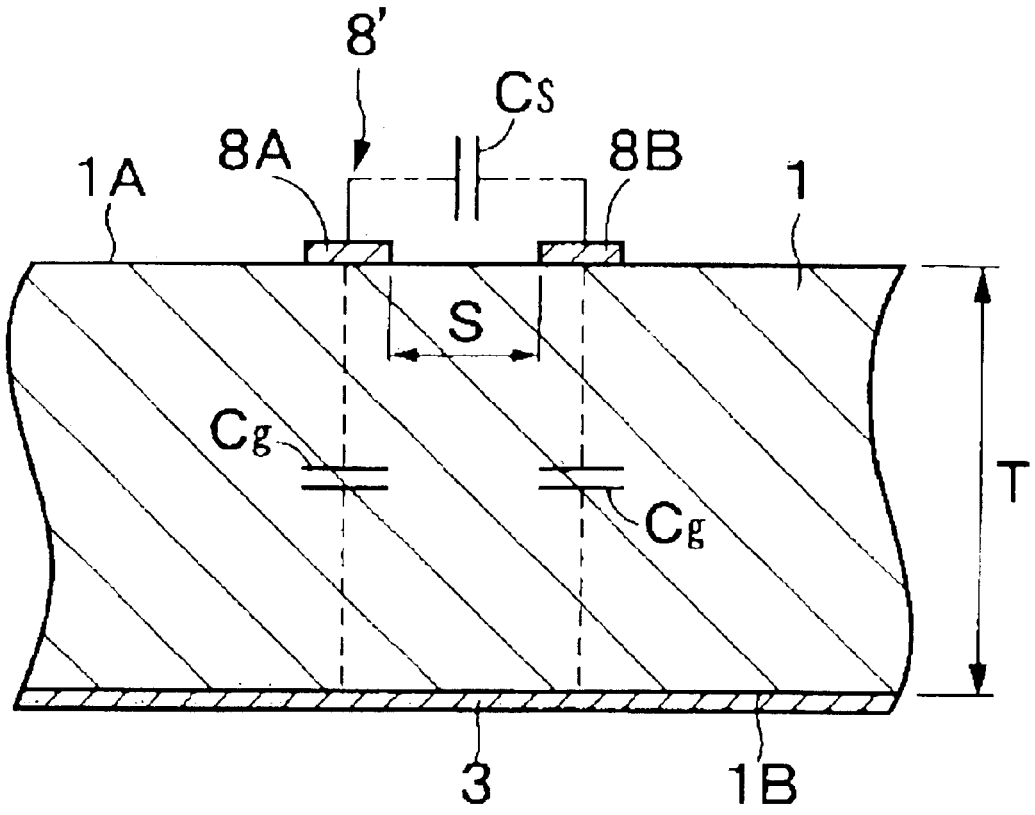
FIG. 9 is an enlarged cross-sectional view taken along the line IX—IX of FIG. 8.
Figure 10:
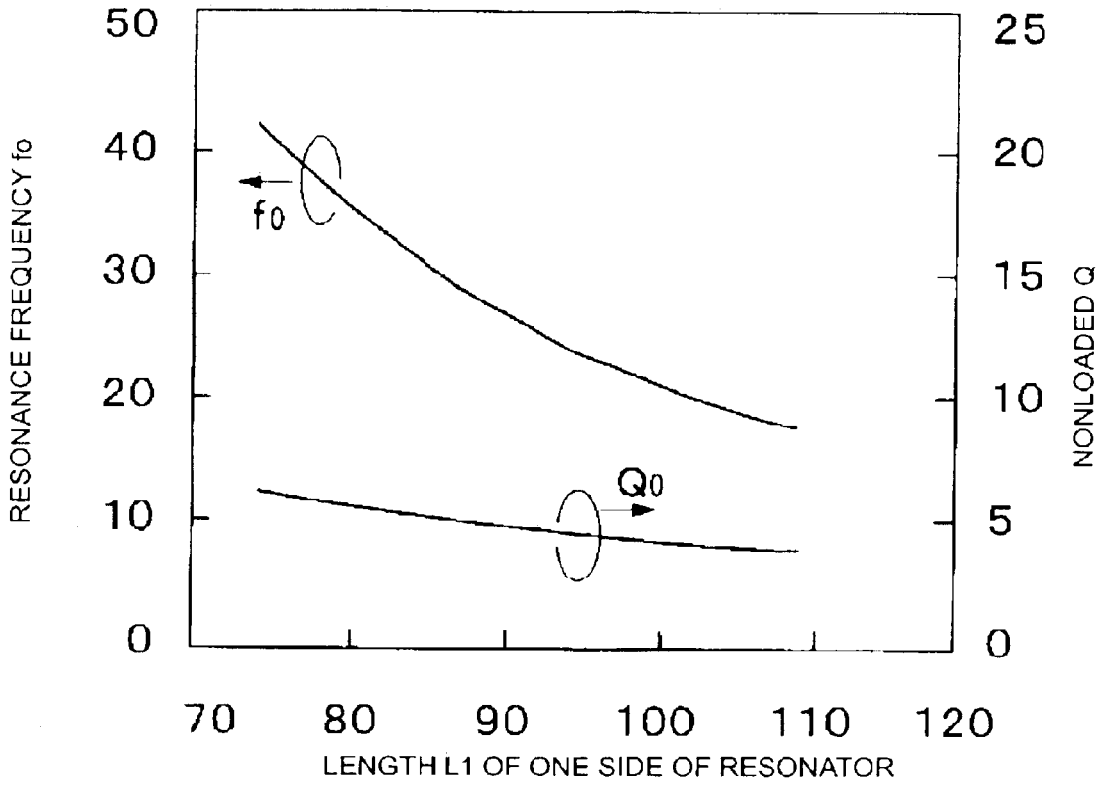
FIG. 10 is a characteristic diagram showing the relationship among the length of one side and the resonance frequency of the resonator and the nonloaded Q according to the first embodiment.

Also, the base ends of the spiral lines 8A and 8B are open between the conductive lines 7A and 7B, and the heads thereof are connected so as to form a connected portion 8C, whereby a hairpin resonator is formed (see FIG. 8). Accordingly, a parallel plate mode (undesired wave) generated between the planar conductors 2 and 3 is coupled with the conductive lines 7A and 7B. Also, when the undesired wave propagates between the conductive lines 7A and 7B, part of the undesired wave is led between the spiral lines 8A and 8B. Since the resonator 8 has a resonance frequency fo, which is defined by a length L0 from the base end to the head, it reflects a high-frequency signal of this resonance frequency fo. Accordingly, the resonator 8 blocks propagation of the undesired wave.

The distance between two adjoining resonators 8 of the conductive lines 7A and 7B is set to a value in which an electrical angle $\theta$ is 90° with respect to the undesired wave (corresponding to the resonance frequency of the resonator 8) to be blocked, that is, to a value which is about ¼ of the wavelength of the undesired wave in the dielectric substrate 1. Accordingly, a phase shifter 9, in which an electrical angle $\theta$ is 90° ($\theta$=90°), can be formed between the two resonators 8. The phase shifter 9 superposes the undesired-wave preventing characteristics of a plurality of resonators 8.

The high-frequency circuit device according to this embodiment has the above-described configuration. Hereinafter, the operation thereof will be described.

First, when a high-frequency signal is input to the slot line 4, the high-frequency signal propagates along the slot line 4 in the longitudinal direction of the dielectric substrate 1. Herein, if a rectangular resonator (not shown) is provided close to the slot line 4 on the top surface 1A of the dielectric substrate 1, an undesired wave such as a parallel plate mode is generated from an unconnected portion between the slot line 4 and the rectangular resonator, and the undesired wave propagates between the planar conductors 2 and 3.

At this time, since the undesired-wave propagation preventing circuits 5, each including the multistage band-elimination filters 6, are provided on the top surface 1A of the dielectric substrate 1, the undesired wave is input to the band-elimination filter 6 of the undesired-wave propagation preventing circuit 5. The band-elimination filter 6 reflects an undesired wave of the band whose center is the resonance frequency fo of the resonator 8, and thus the propagation of the undesired wave can be blocked.

Next, the operation of the resonator 8 will be described with reference to FIGS. 5 to 10. Herein, the resonator 8 is substantially square-shaped, as shown in FIG. 6.

The resonator 8 includes the spiral lines 8A and 8B, whose heads are connected. Thus, the resonator 8 operates in almost the same way as a hairpin resonator 8' formed by extending the spiral lines 8A and 8B linearly, as shown in FIG. 8, so as to form the band-elimination filter 6 including a parallel resonance circuit in which a capacitor C and an inductor L are connected in parallel, as shown in an equivalent circuit in FIG. 5. Accordingly, the resonator 8 reflects an undesired wave of bands whose center is the resonance frequency fo defined by the following expression 1.

$$fo = \frac{1}{2\pi\sqrt{LC}} \quad \text{Expression 1}$$

Herein, the gap S between the spiral lines 8A and 8B is set to 1/10 or less of the thickness T of the dielectric substrate 1. Thus, the capacitance Cs generated between the spiral lines 8A and 8B is sufficiently larger than the capacitance Cg generated between the spiral lines 8A and 8B and the planar conductor 3 (see FIG. 9).

As a result, the capacitance C of the resonator 8 depends on the capacitance Cs generated between the spiral lines 8A and 8B. As the space S between the spiral lines 8A and 8B becomes narrower, the capacitance Cs between the spiral lines 8A and 8B becomes larger. Accordingly, the resonance frequency fo can be decreased while the resonator 8 is miniaturized.

Also, as the length L0 of the spiral lines 8A and 8B becomes larger, the inductance L and the capacitance Cs become larger. Therefore, compared to the known art, in which each of the capacitance C and the inductance L is independently increased, the capacitance C (capacitance Cs) and the inductance L can be increased while suppressing an increase in the area of the resonator 8. Thus, when an undesired wave of the same frequency is blocked, the area of the band-elimination filter 6 including the resonator 8 can be decreased to about 60 to 80% compared to the area of a conductor pattern forming the low-pass filter of the known art.

Next, the band-stop characteristic of the resonator 8 and the undesired-wave propagation preventing circuit 5 is considered.

First, an electromagnetic field simulation was performed by using the resonator 8 shown in FIG. 6, in which the width W of each of the spiral lines 8A and 8B is set to 2 $\mu$m, the gap S between the spiral lines 8A and 8B is set to 2 $\mu$m, and the number of winding of the spiral lines 8A and 8B is set to 3. Accordingly, as show in FIG. 10, the resonance frequency fo and the nonloaded Q (Qo) when the length L1 of one side of the resonator 8 is changed from about 80 to 110 $\mu$m were obtained.

As can be seen, the resonance frequency fo is high when the length L1 of one side of the resonator 8 is small, and the resonance frequency fo is low when the length L1 is large. Further, the nonloaded Q of the resonator 8 tends to decrease as the length L1 becomes large, but is always be about 5.

Figure 5:
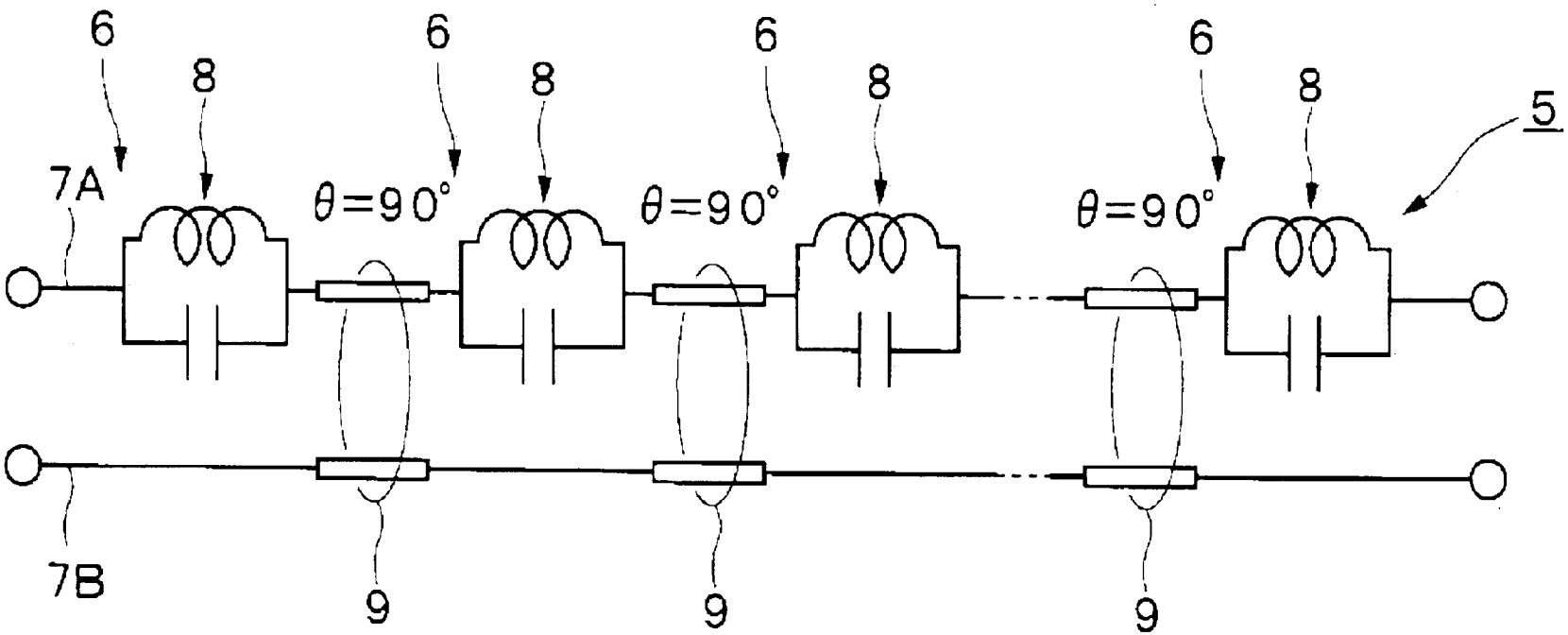
FIG. 5 is a circuit diagram showing an equivalent circuit of the undesired-wave propagation preventing circuit according to the first embodiment.
Figure 6:
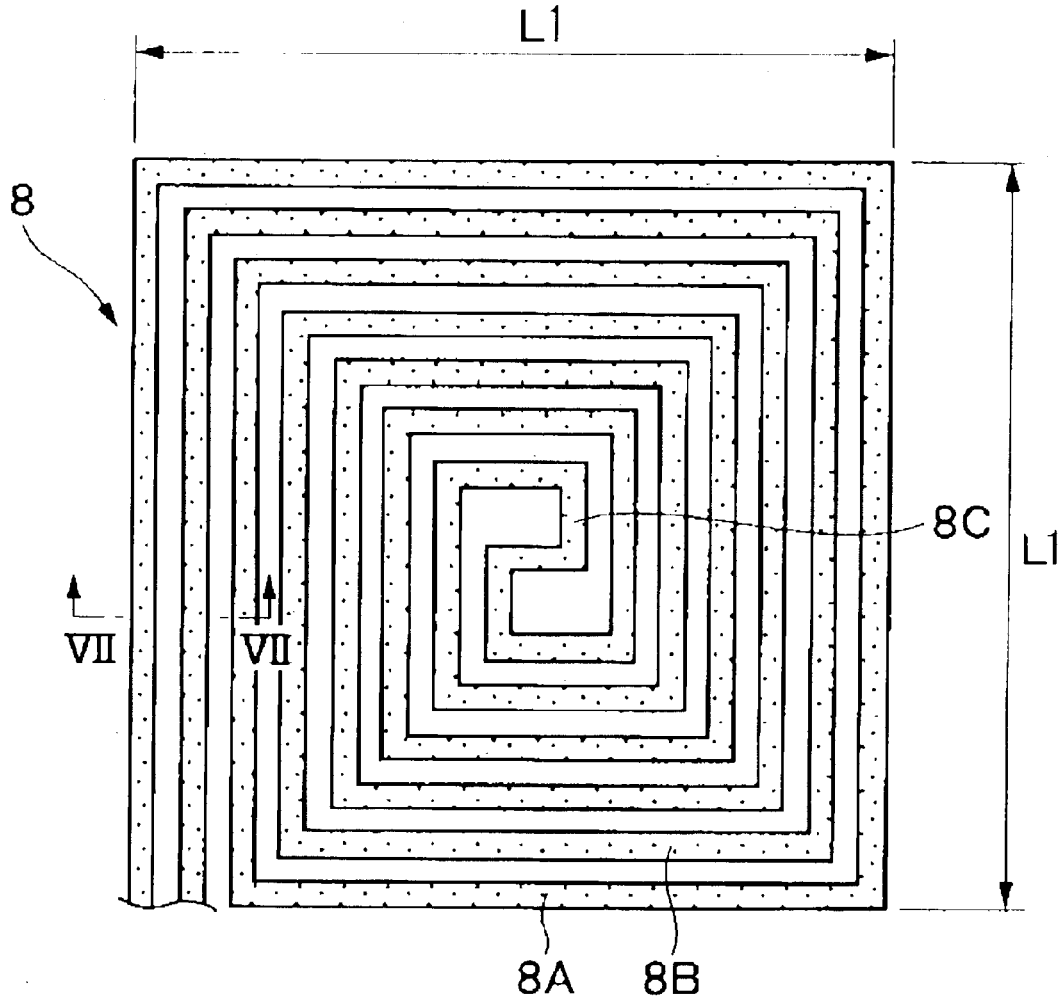
FIG. 6 is an enlarged plan view showing a resonator according to the first embodiment.
Figure 7:
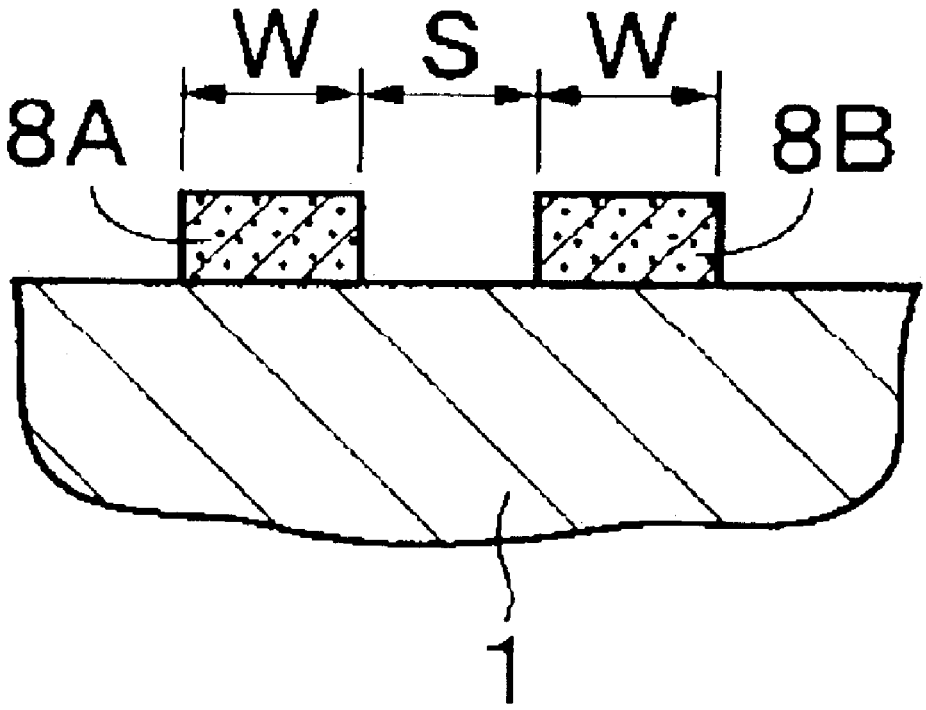
FIG. 7 is an enlarged cross-sectional view taken along the line VII—VII of spiral lines shown in FIG. 6.
Figure 11:
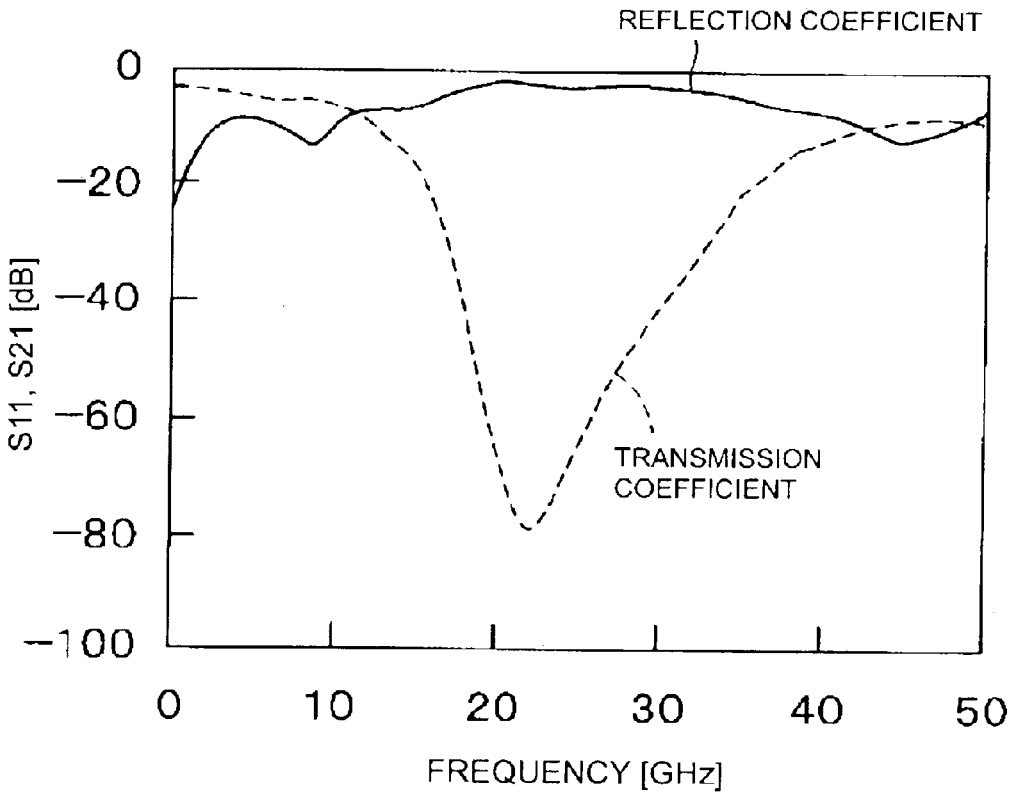
FIG. 11 is a characteristic diagram showing the transmission characteristic of the undesired-wave propagation preventing circuit according to the first embodiment.

Circuit analysis of the undesired-wave propagation preventing circuit 5 was performed by using the equivalent circuit shown in FIG. 5 in a state where the resonance frequency fo of the resonator 8 is 21 GHz, the nonloaded Q is 5, and four band-elimination filters 6 are connected. FIG. 11 shows the obtained transmission characteristic.

As can be seen, the transmission coefficient S21 significantly decreases compared to the reflection coefficient S11, especially at the resonance frequency fo. Thus, the undesired-wave propagation preventing circuit 5 can block propagation of an undesired wave of band whose center is the resonance frequency fo.

In this embodiment, each band-elimination filter 6 of the undesired-wave propagation preventing circuit 5 includes the two conductive lines 7A and 7B and the resonator 8, which is provided at a portion of the conductive line 7A and which includes the two spiral lines 8A and 8B. With this configuration, the hairpin resonator 8 can be formed by connecting the heads of the two spiral lines 8A and 8B. Also, propagation of an undesired-wave of the band whose center is the resonance frequency fo can be blocked by using the resonator 8.

Also, since the resonator 8 includes the two spiral lines 8A and 8B, the resonator 8 can be accommodated in a small rectangular area. In particular, in the hairpin resonator 8, the magnetic field strength of the head side, at which the spiral lines 8A and 8B are connected, is larger than the magnetic field strength of the other portions, and thus the magnetic field can be concentrated to the center of the spiral resonator 8. As a result, a magnetic field coupling does not occur between the resonator 8 and another circuit, and thus effects of other circuits can be eliminated and an undesired wave can be blocked.

Further, the width W of each of the spiral lines 8A and 8B is set to the same value along the entire length thereof and the gap S between the two spiral lines 8A and 8B is set to the same value along the entire length thereof. Accordingly, by setting the width W of each of the spiral lines 8A and 8B and the gap S to a small value, the capacitance C and the inductance L of the resonator 8 can be increased. Also, the frequency band of an undesired wave which can be blocked can be decreased while suppressing an increase in the area of the resonator 8.

Also, the resonator 8 of each stage is provided in the conductive line 7A, which is one of the two conductive lines 7A and 7B. Therefore, when an undesired wave propagates between the conductive lines 7A and 7B, this undesired wave can be led to the resonator 8 provided in the conductive line 7A and can be blocked by the resonator 8.

Further, the gap S between the two spiral lines 8A and 8B is set to 1/10 or less of the thickness T of the dielectric substrate 1, that is, the space between the two planar conductors 2 and 3. With this configuration, the capacitance Cs generated between the two spiral lines 8A and 8B can be made to be larger than the capacitance Cg generated between the spiral lines 8A and 8B and the planar conductor 3. Accordingly, the resonance frequency fo of the resonator 8 can be decreased by decreasing the gap S between the two spiral lines 8A and 8B, and the resonance frequency fo of the resonator 8 can be increased by decreasing the length L0 of the spiral lines 8A and 8B. Therefore, in order to block an undesired wave of the same frequency, the band-elimination filter 6 including the resonator 8 can be miniaturized compared to the conductive pattern forming the low-pass filter of the known art, and thus the undesired-wave propagation preventing circuit 5 can be miniaturized. As a result, the dielectric substrate 1 can be miniaturized and the manufacturing cost can be reduced.

Figure 12:
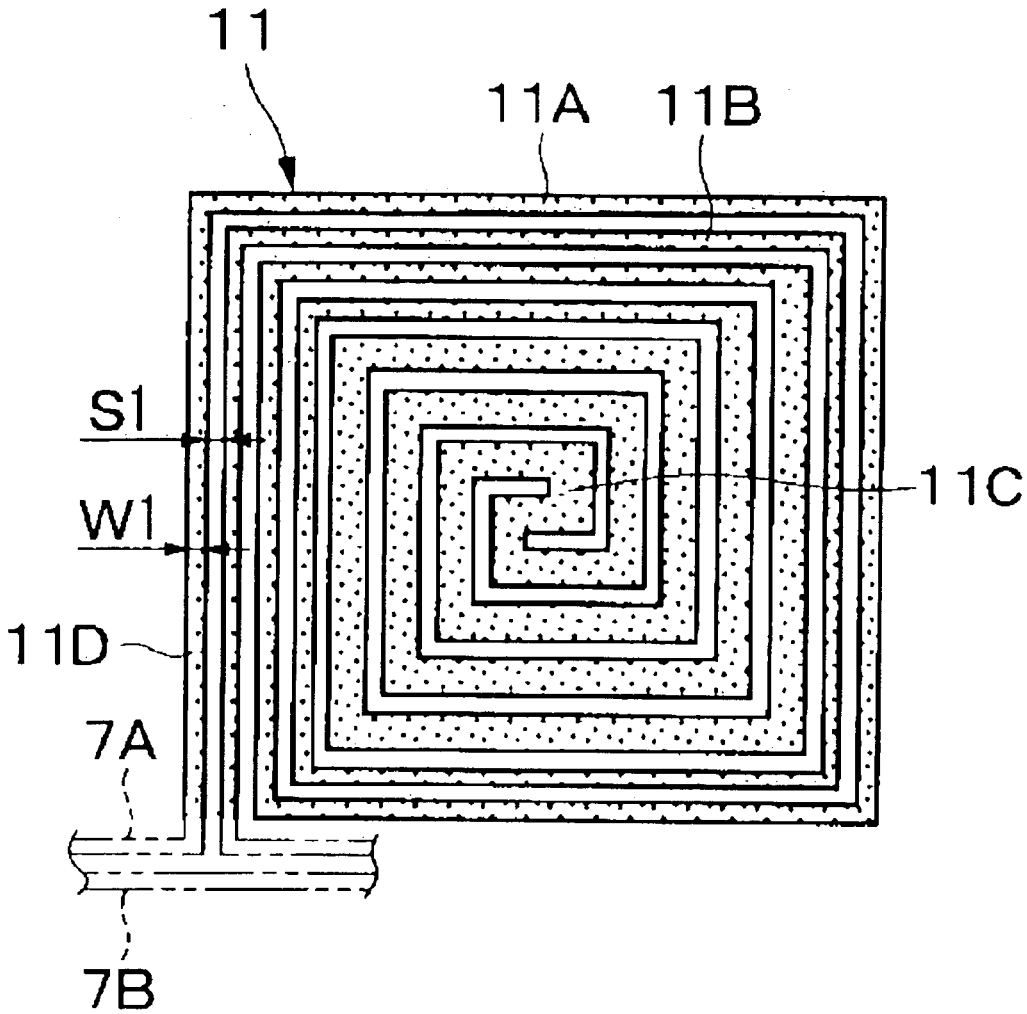
FIG. 12 is an enlarged plan view showing a resonator according to a second embodiment.

FIG. 12 shows a second embodiment of the present invention. This embodiment is characterized in that the width of the spiral line forming the resonator is larger at the center side than at the periphery side. In this embodiment, elements which are the same as in the first embodiment are denoted by the same reference numerals, and the corresponding description will be omitted.

A resonator 11 according to the second embodiment is provided at a portion of the conductive line 7A and includes two spiral lines 11A and 11B, which extend in parallel to each other and form a rectangular spiral. As in the resonator 8 of the first embodiment, the heads of the spiral lines 11A and 11B are connected so as to form a connected portion 11C. Also, the base ends thereof form an opening portion 11D, which is open between the conductive lines 7A and 7B, whereby a hairpin resonator is formed.

The width W1 of each of the spiral lines 11A and 11B is set such that the width W1 is large at the center (around the connected portion 11C) of the resonator 11 and is small at the periphery (opening portion 11D side). On the other hand, the gap S1 between the two spiral lines 11A and 11B is set to the same value along the entire length thereof.

Accordingly, the same operation and advantage as in the first embodiment can be obtained in the second embodiment. Furthermore, in the second embodiment, the width W1 of each of the spiral lines 11A and 11B is larger at the center than at the periphery. With this arrangement, the path of a current can be broadened at the center of the spiral, in which the magnetic field strength is large. Accordingly, concentration of current can be alleviated and the nonloaded Q of the resonator 11 can be improved (loss can be reduced).

Figure 13:
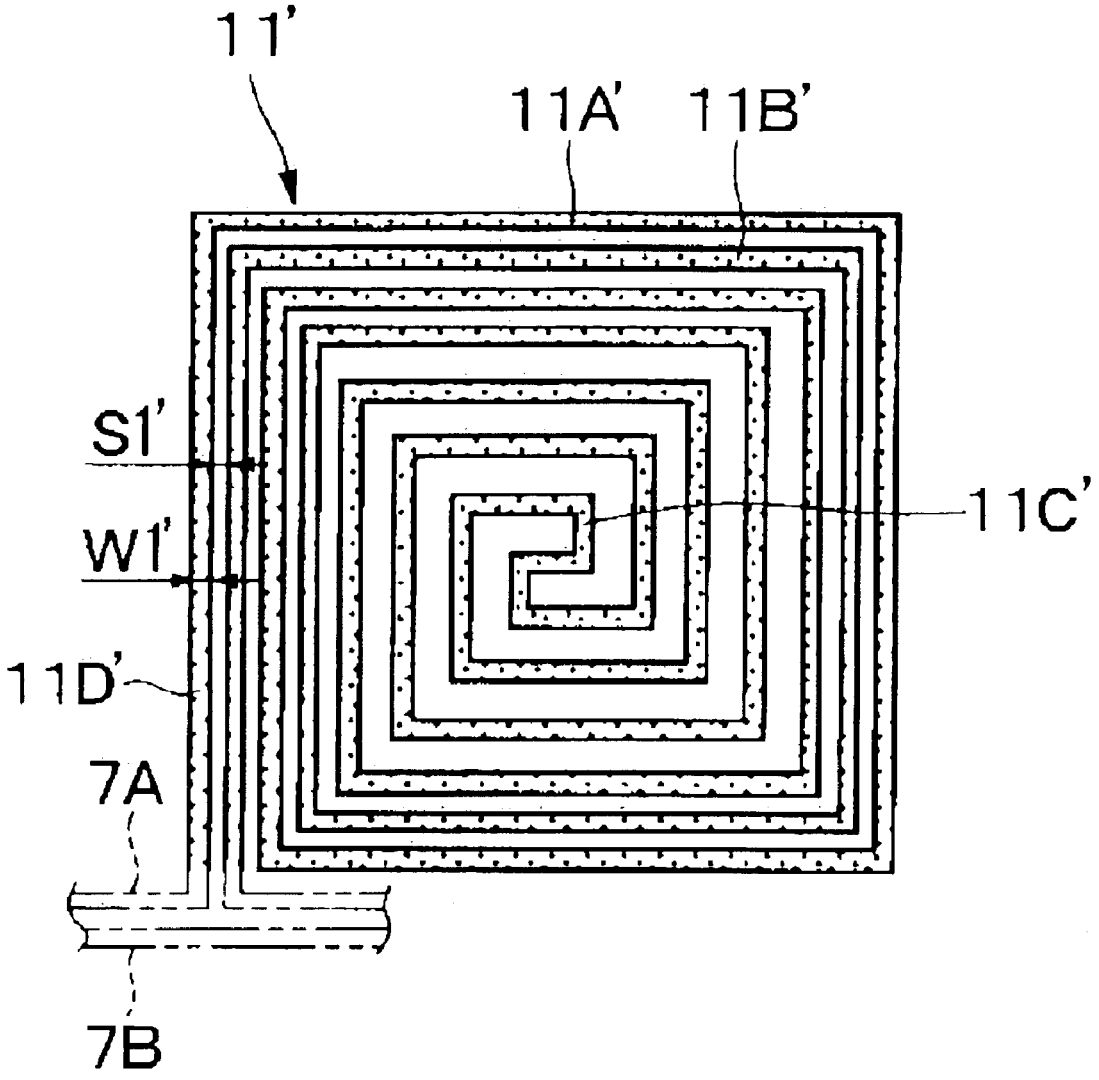
FIG. 13 is an enlarged plan view showing a resonator according to a modification.

In the second embodiment, the width W1 of each of the spiral lines 11A and 11B of the resonator 11 is larger at the center of the spiral than at the periphery. However, the present invention is not limited to this configuration. For example, as in a modification shown in FIG. 13, the gap S1' between two spiral lines 11A' and 11B' of a resonator 11' can be set such that the space S1' is wide at the center side of the spiral and is narrow at the periphery side. With this configuration, the same advantage as in the second embodiment can be obtained.

Figure 14:
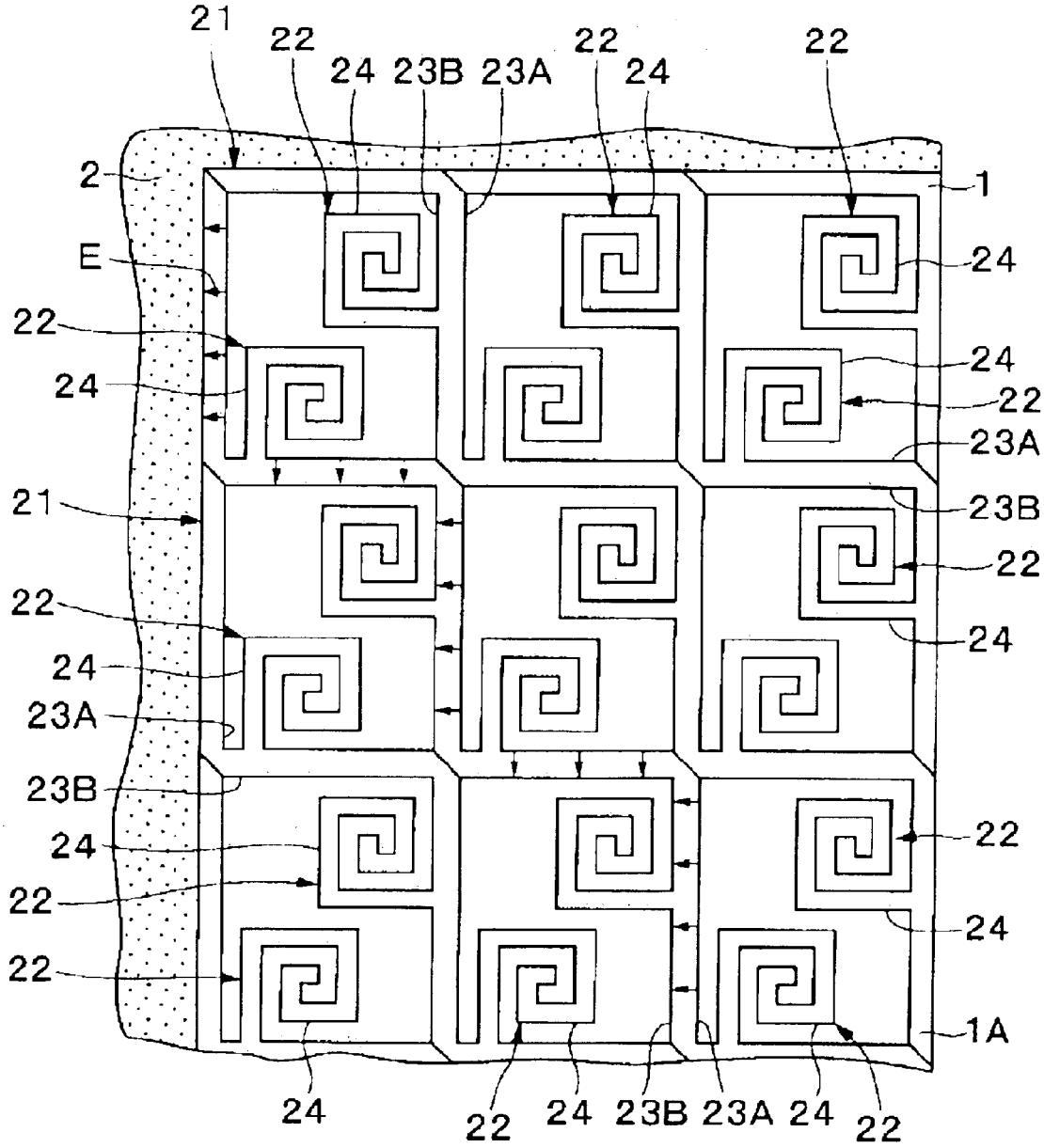
FIG. 14 is an enlarged plan view showing the critical portion of an undesired-wave propagation preventing circuit according to a third embodiment.
Figure 15:
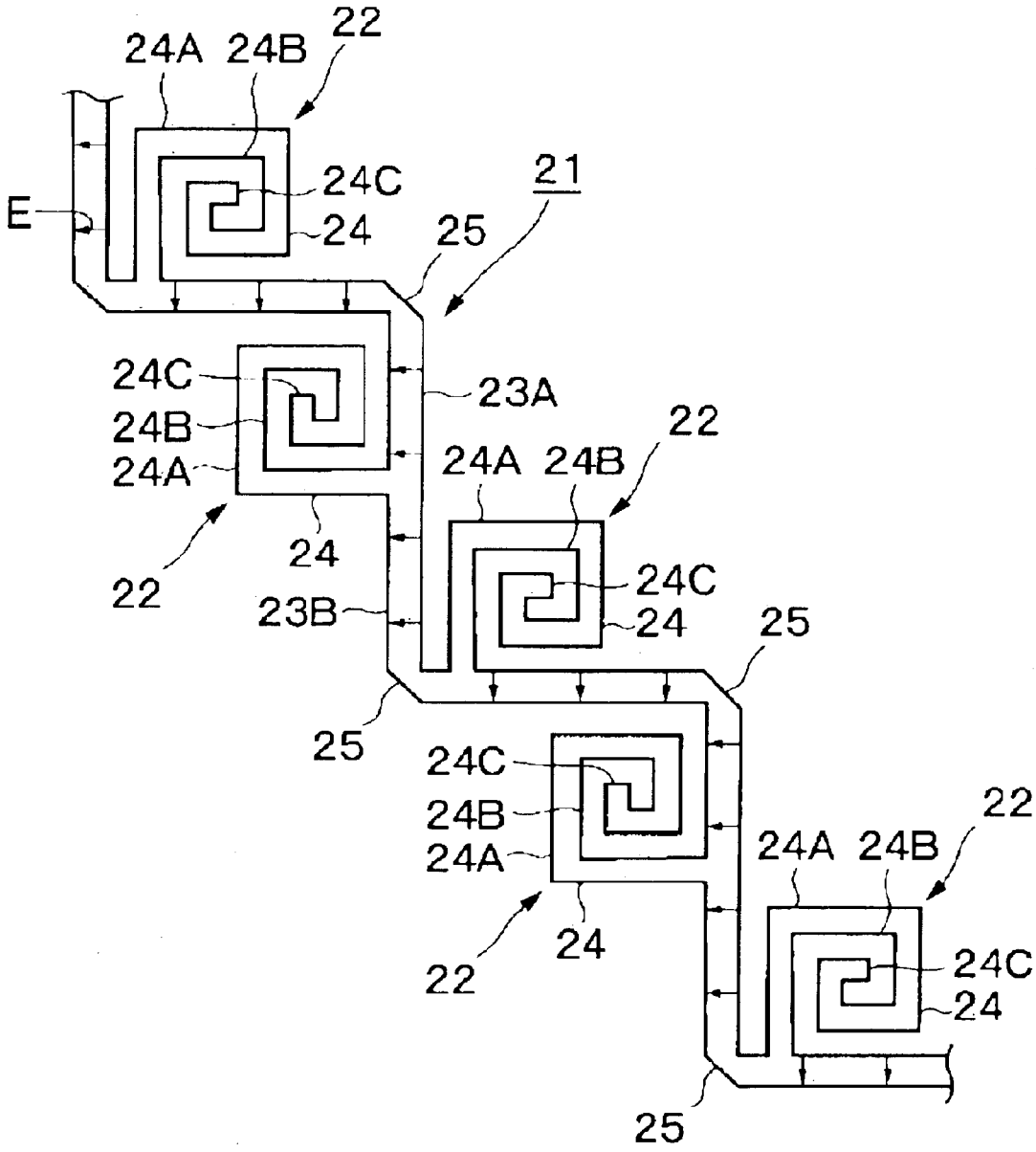
FIG. 15 is an enlarged plan view showing the critical portion of a single undesired-wave propagation preventing circuit shown in FIG. 14.
Figure 16:
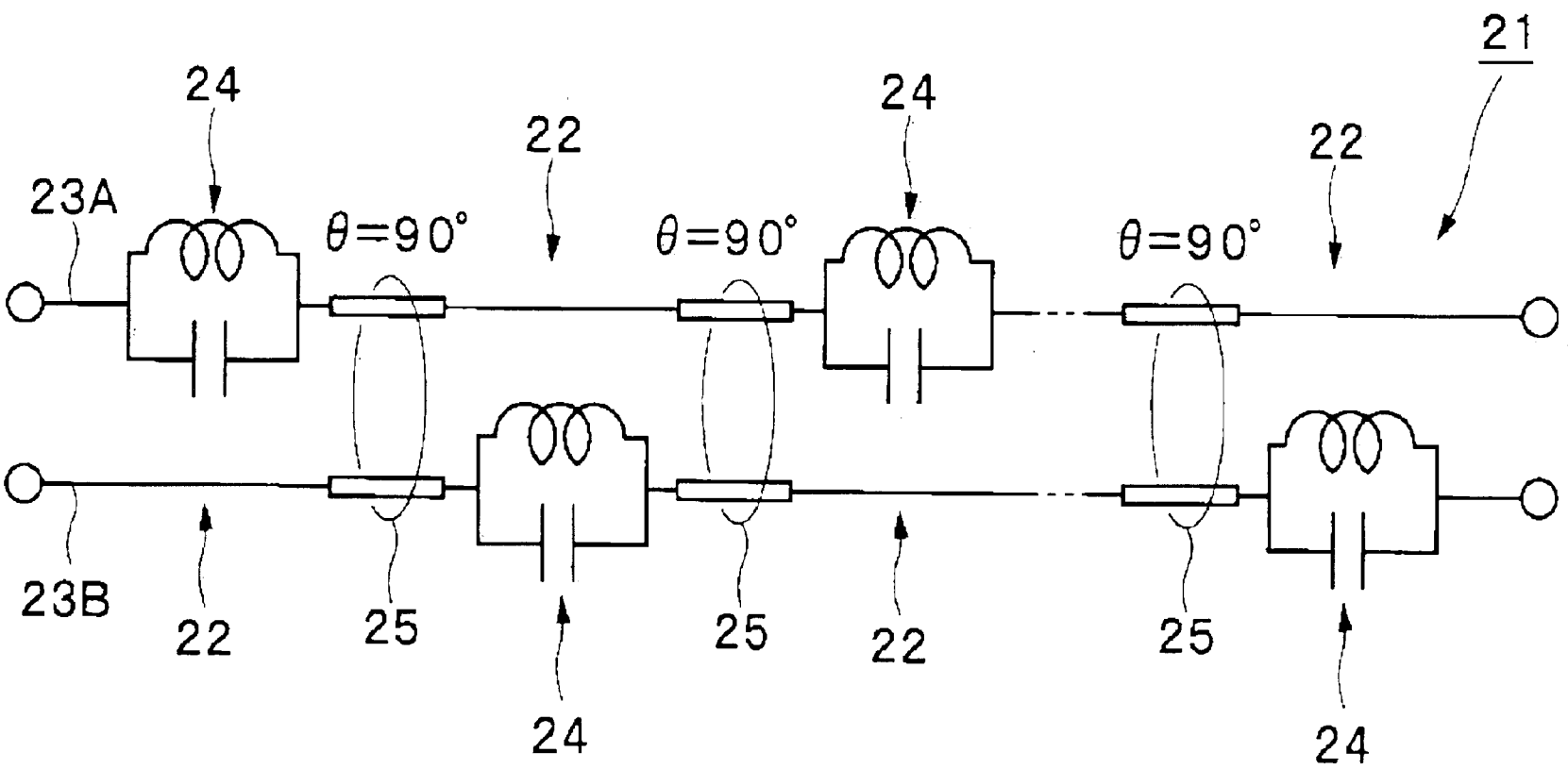
FIG. 16 is a circuit diagram showing an equivalent circuit of the undesired-wave propagation preventing circuit according to the third embodiment.
Figure 17:
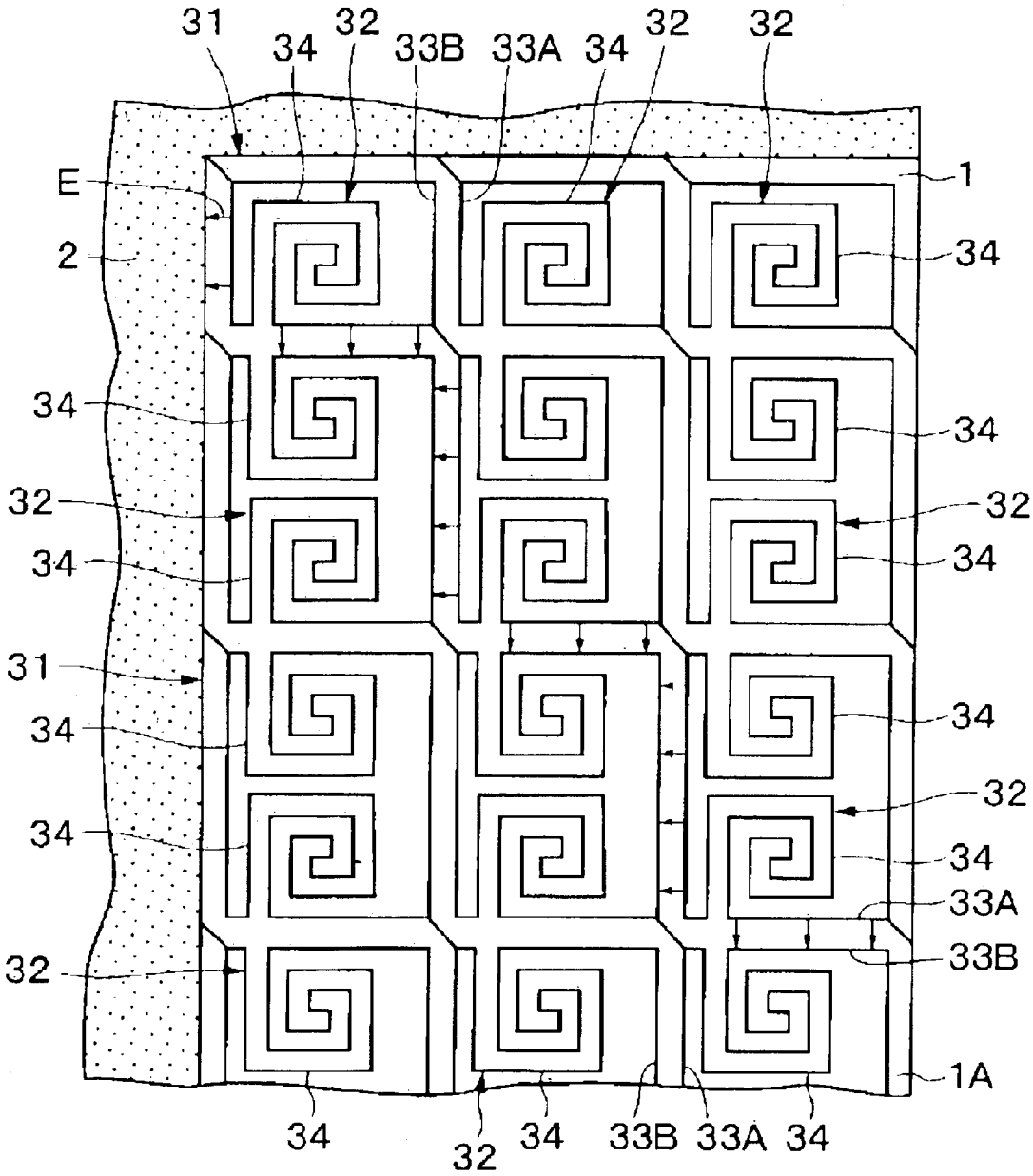
FIG. 17 is an enlarged plan view showing the critical portion of an undesired-wave propagation preventing circuit according to a fourth embodiment.
Figure 18:
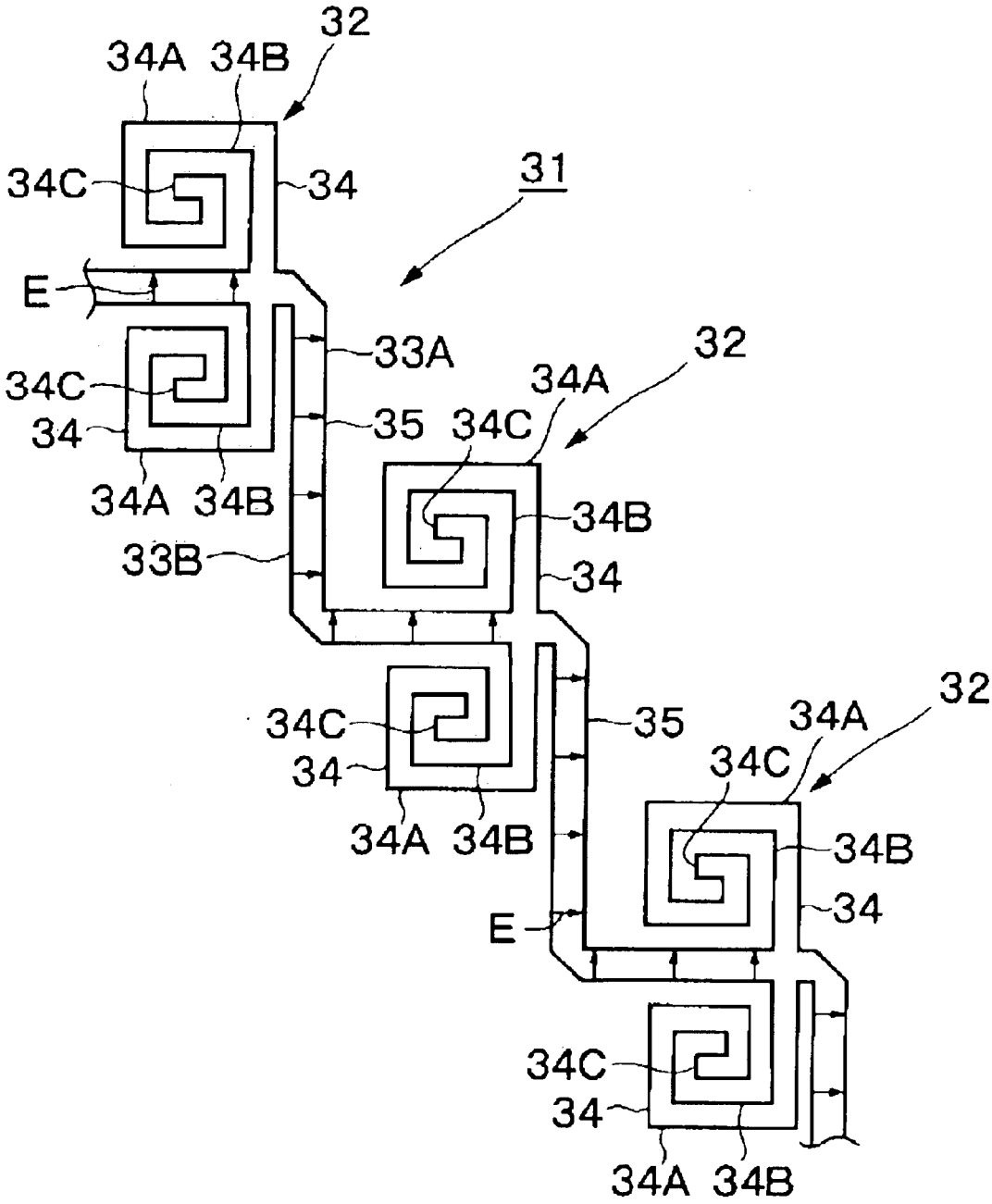
FIG. 18 is an enlarged plan view showing the critical portion of a single undesired-wave propagation preventing circuit shown in FIG. 17.

FIGS. 14 to 16 show a third embodiment of the present invention. The third embodiment is characterized in that the resonators forming the band-elimination filters 22 of adjoining stages are provided in one of the two conductive lines, alternately. In the third embodiment, elements which are the same as in the first embodiment are denoted by the same reference numerals, and the corresponding description will be omitted.

An undesired-wave propagation preventing circuit 21 is provided on the planar conductor 2 and includes multistage band-elimination filters 22, which will be described later.

Each of the band-elimination filters 22 forming the undesired-wave propagation preventing circuit 21 includes two conductive lines 23A and 23B, which are connected to each other at an interstage, and a resonator 24 which is provided alternately in the conductive lines 23A and 23B in adjoining stages. The band-elimination filters 22 are placed on the top surface 1A of the dielectric substrate 1 in a meshed pattern, and are staggered in a slanting direction with respect to the longitudinal direction of the dielectric substrate 1 and are coupled in the vertical direction, as in the band-elimination filters 6 according to the first embodiment.

The resonator 24 is provided at a portion of any one the conductive lines 23A and 23B and includes two spiral lines 24A and 24B extending in parallel to each other and forming a spiral. Also, the base ends of the spiral lines 24A and 24B are open between the conductive lines 23A and 23B and the heads thereof are connected so as to form a connected portion 24C. Accordingly, a hairpin resonator is formed.

Further, the distance between two adjoining resonators 24 of the conductive lines 23A and 23B is set to a value in which an electrical angle θ is 90° with respect to the undesired wave to be blocked. Accordingly, a phase shifter 25, in which an electrical angle θ is 90° (θ=90°), can be formed between the two resonators 24. The phase shifter 25 superposes the undesired-wave preventing characteristics of a plurality of resonators 24.

Accordingly, the same operation and advantage as in the first embodiment can be obtained in the third embodiment. Further, in the third embodiment, the resonators 24 forming the band-elimination filters 22 of adjoining stages are provided in one of the two conductive lines 23A and 23B, alternately, and thus the resonators 24 can be placed in a staggered pattern to the conductive line 23A or 23B. Therefore, when an undesired wave propagates between the two conductive lines 23A and 23B, propagation of the undesired wave can be blocked by using the resonators 24 placed in a staggered pattern.

FIGS. 17 to 20 show a fourth embodiment of the present invention. The fourth embodiment is characterized in that a resonator forming the band-elimination filter 32 in each stage is provided in each of two conductive lines. In this embodiment, elements which are the same as in the first embodiment are denoted by the same reference numerals, and the corresponding description will be omitted.

An undesired-wave propagation preventing circuit 31 is provided on the planar conductor 2 and includes multistage band-elimination filters 32, which will be described later.

Each of the band-elimination filters 32 forming the undesired-wave propagation preventing circuit 31 includes two conductive lines 33A and 33B, which are connected to each other at an interstage, and resonators 34 provided in the two conductive lines 33A and 33B, respectively. The band-elimination filters 32 are placed on the top surface 1A of the dielectric substrate 1 in a meshed pattern, and are staggered in a slanting direction with respect to the longitudinal direction of the dielectric substrate 1 and are coupled in the vertical direction, as in the band-elimination filters 6 of the first embodiment.

The resonator 34 is provided at a portion of each of the conductive lines 33A and 33B and includes two spiral lines 34A and 34B extending in parallel to each other and forming a rectangular spiral. Also, the base ends of the spiral lines 34A and 34B are open between the conductive lines 33A and 33B and the heads thereof are connected so as to form a connected portion 34C. Accordingly, a hairpin resonator is formed. Also, the two resonators 34 forming the band-elimination filter 32 of each stage are placed in a substantially symmetrical pattern, with the conductive lines 33A and 33B therebetween.

Further, the distance between two adjoining resonators 34 of the conductive lines 33A and 33B is set to a value in which an electrical angle θ is 90° with respect to the undesired wave to be blocked. Accordingly, a phase shifter 35, in which an electrical angle θ is 90° (θ=90°), can be formed between the two resonators 34. The phase shifter 35 superposes the undesired-wave preventing characteristics of a plurality of resonators 34.

Accordingly, the same operation and advantage as in the first embodiment can be obtained in the fourth embodiment. Further, in the fourth embodiment, the resonator 34 forming the band-elimination filter 32 of each stage is provided in each of the two conductive lines 33A and 33B. With this arrangement, when an undesired wave propagates between the two conductive lines 33A and 33B, the undesired wave can be blocked by the resonators 34 provided in the two conductive lines 33A and 33B, respectively. In particular, since two resonators 34 are provided in the band-elimination filter 32 of each stage, the number of resonators 34 connected to the conductive lines 33A and 33B can be increased.

Figure 19:
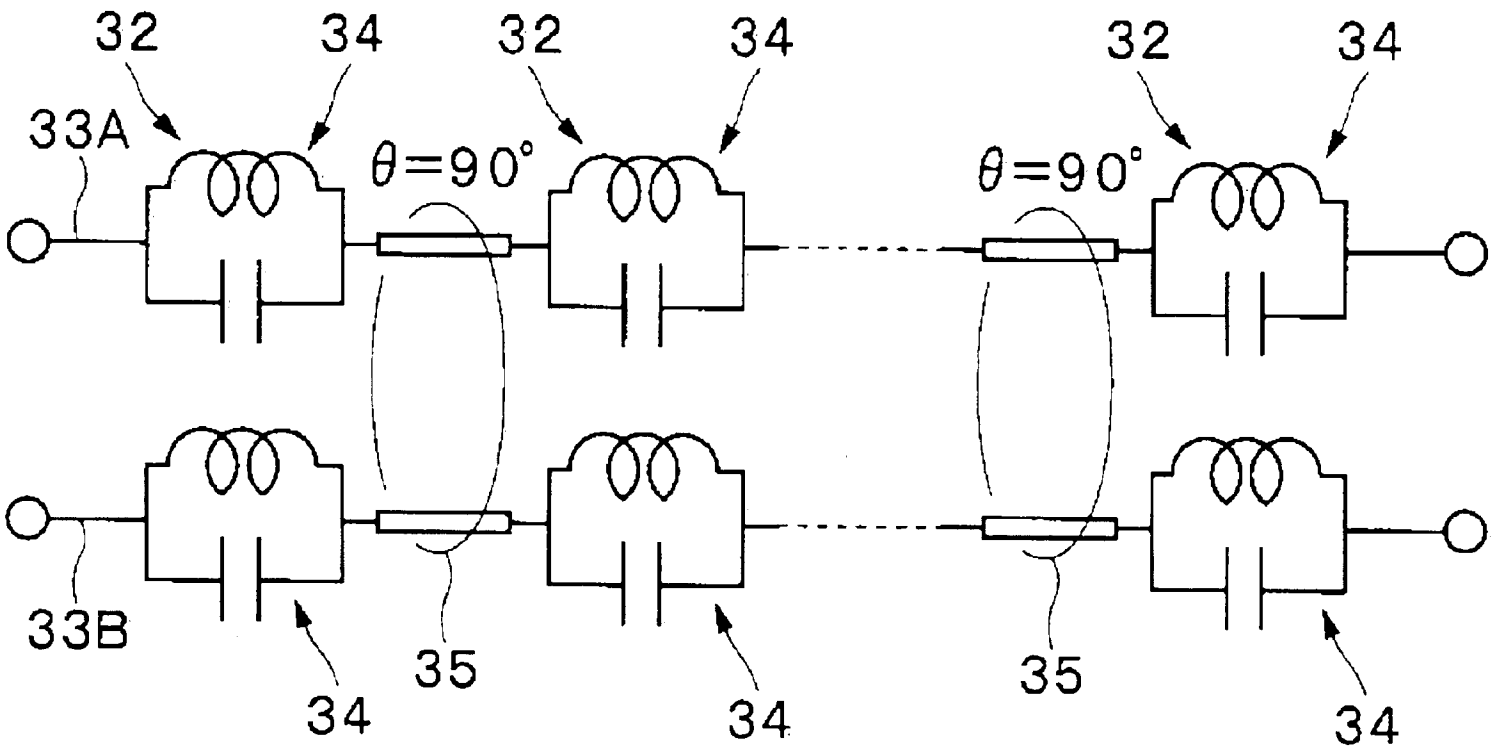
FIG. 19 is a circuit diagram showing an equivalent circuit of the undesired-wave propagation preventing circuit according to the fourth embodiment.
Figure 20:
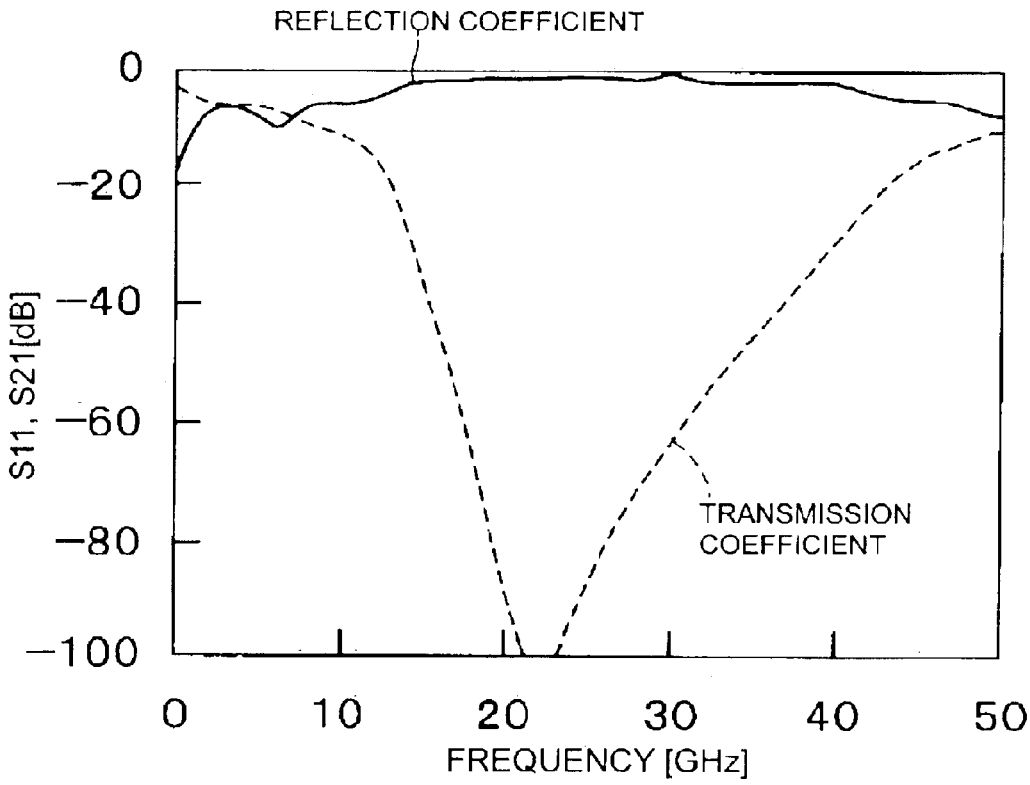
FIG. 20 is a characteristic diagram showing the transmission characteristic of the undesired-wave propagation preventing circuit according to the fourth embodiment.

Circuit analysis of the undesired-wave propagation preventing circuit 31 was performed by using the equivalent circuit shown in FIG. 19 in a state where the resonance frequency fo of the resonator 34 is 21 GHz, the nonloaded Q is 5, and four hand-elimination filters 32 are connected. FIG. 20 shows the obtained transmission characteristic.

As can be seen, the transmission coefficient S21 significantly decreases compared to the reflection coefficient S11, especially at the resonance frequency fo. Thus, the undesired-wave propagation preventing circuit 31 can block propagation of an undesired wave of band whose center is the resonance frequency fo. Additionally, the band for blocking an undesired wave can be broadened compared to the first embodiment.

Figure 21:
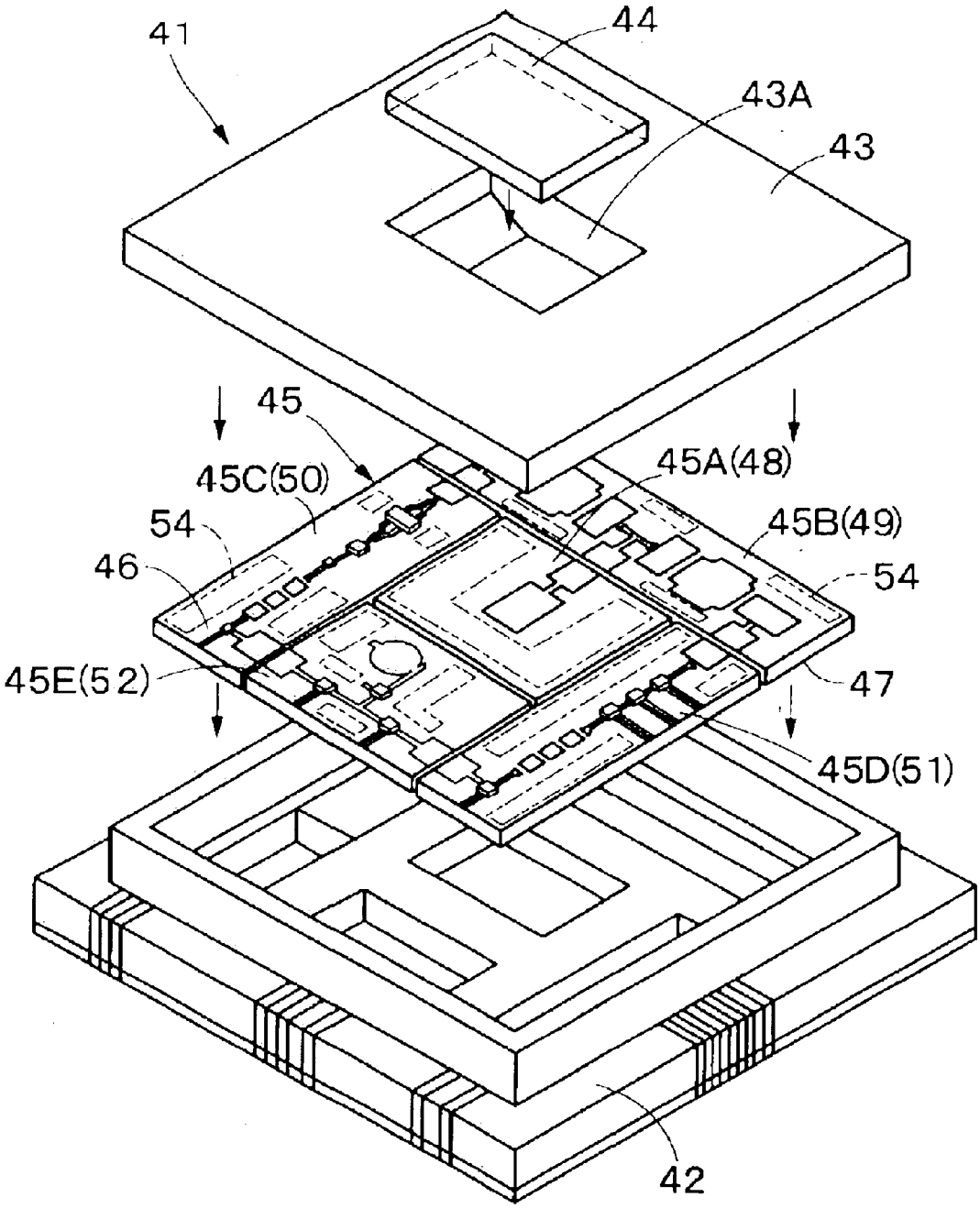
FIG. 21 is an exploded perspective view showing a communication apparatus according to a fifth embodiment.
Figure 22:
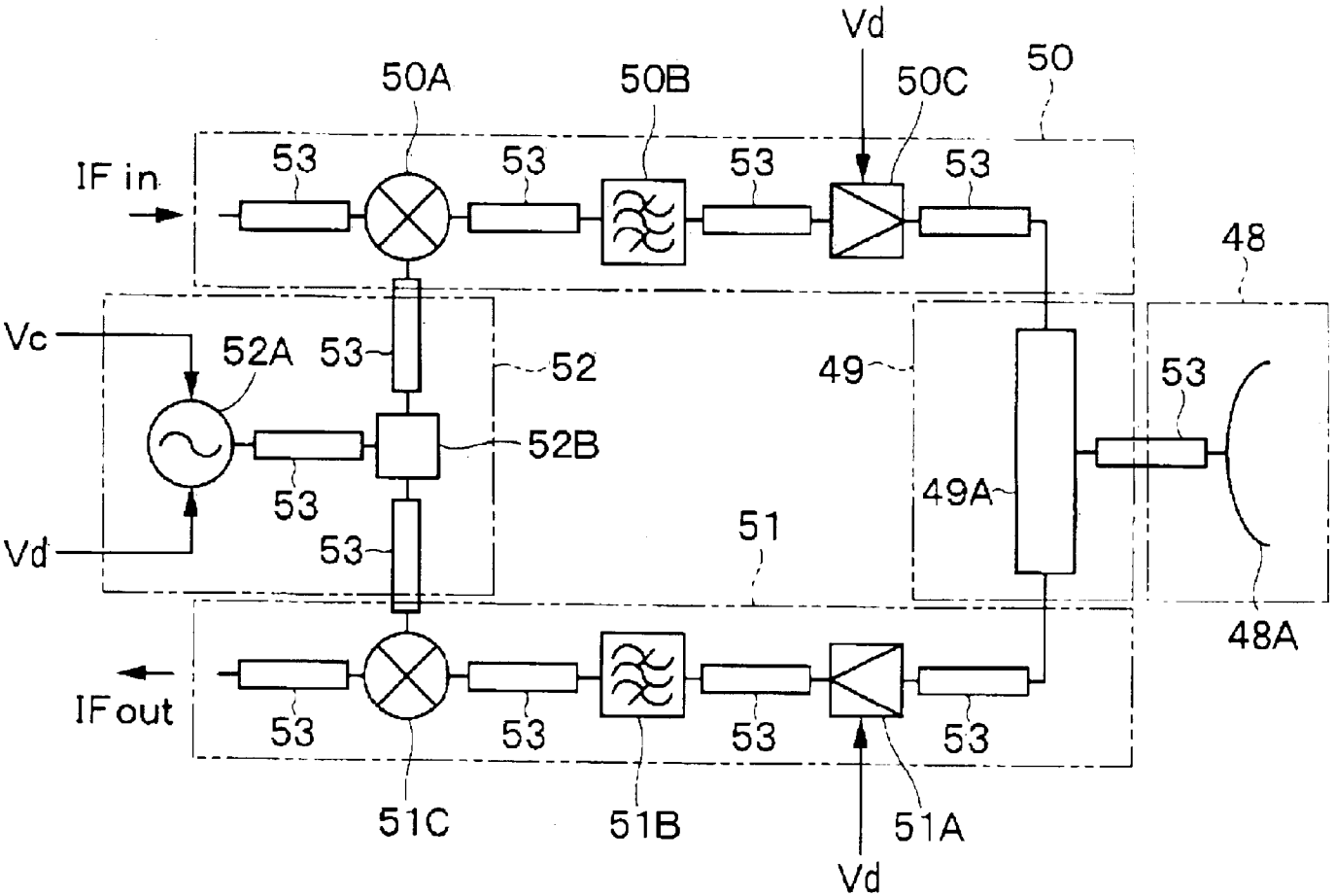
FIG. 22 is a block diagram showing the entire configuration of the communication apparatus according to the fifth embodiment.

FIGS. 21 and 22 show a fifth embodiment of the present invention. The fifth embodiment is characterized in that the above-described undesired-wave propagation preventing circuit is applied to a communication apparatus serving as a transmitter/receiver. In this embodiment, elements which are the same as in the first embodiment are denoted by the same reference numerals, and the corresponding description will be omitted.

A resin package 41 forms the outline of the communication apparatus and includes a box-shaped casing 42 whose upper side is open and a cover 43 which covers the opening of the casing 42 and which is substantially square-shaped plate. Also, a substantially square opening 43A is provided at the center of the cover 43 and a blockage plate 44 through which electromagnetic waves can be transmitted is provided in the opening 43A.

A dielectric substrate 45 is accommodated in the casing 42 and includes five divided substrates 45A to 45E. Both principal surfaces of each of the divided substrates 45A to 45E are covered with planar conductors 46 and 47, respectively. Further, an antenna block 48, a duplexer block 49, a transmission block 50, a reception block 51, and an oscillator block 52, serving as functional blocks, are provided in the divided substrates 45A to 45E, respectively.

The antenna block 48 is used for transmitting a transmission radio wave and receiving a reception radio wave. The antenna block 48 is provided in the divided substrate 45A positioned at the center of the dielectric substrate 45 and includes a radiation slot 48A which is formed in the planar conductor 46 and which forms a square opening. The radiation slot 48A is connected to the duplexer block 49 via a transmission line 53, which will be describe later.

The duplexer block 49 serves as an antenna duplexer and includes a resonator 49A formed by a square opening formed in the planar conductor 46 of the divided substrate 45B. The resonator 49A is connected to the antenna block 48, the transmission block 50, and the reception block 51, via the transmission line 53, which will be described later.

The transmission block 50 is used for outputting a transmission signal to the antenna block 48. The transmission block 50 includes a mixer 50A which is formed by using an electronic component such as a field-effect transistor mounted on the divided substrate 45C and which mixes an intermediate-frequency signal IF to a carrier wave output from the oscillator block 52 so as to generate a transmission signal by up-converting; a band-pass filter 50B for removing noise from the transmission signal output from the mixer 50A; and a power amplifier 50C which is formed by using an electronic component operated by a bias voltage Vd and which amplifies the power of the transmission signal.

The mixer 50A, the band-pass filter 50B, and the power amplifier 50C are mutually connected via the transmission line 53. Also, the mixer 50A is connected to the oscillator block 52 via the transmission line 53 and the power amplifier 50C is connected to the duplexer block 49 via the transmission line 53.

The reception block 51 is provided in the divided substrate 45D, receives a reception signal received by the antenna block 48, and mixes the reception signal and a carrier wave output from the oscillator block 52 so as to generate an intermediate-frequency signal IF by down-converting. The reception block 51 includes a low-noise amplifier 51A which is formed by using an electronic component operated by a bias voltage Vd and which amplifies the reception signal at low noise; a band-pass filter 51B for removing noise from the reception signal output from the low-noise amplifier 51A; and a mixer 51C which mixes the carrier wave output from the oscillator block 52 and the reception signal output from the band-pass filter 51B so as to generate an intermediate-frequency signal IF by down-converting.

The low-noise amplifier 51A, the band-pass filter 51B, and the mixer 51C are mutually connected via the transmission line 53. Also, the low-noise amplifier 51A is connected to the duplexer block 49 via the transmission line 53 and the mixer 51C is connected to the oscillator block 52 via the transmission line 53.

The oscillator block 52 is provided in the divided substrate 45E, is connected to the transmission block 50 and the reception block 51, and oscillates a signal of a predetermined frequency which is a carrier wave (for example, a high-frequency signal such as a microwave or a millimeter wave). The oscillator block 52 includes a voltage-controlled oscillator 52A which is formed by using an electronic component operated by a bias voltage Vd and which oscillates a signal of the frequency corresponding to a control signal Vc; and a branch circuit 52B for supplying the signal from the voltage-controlled oscillator 52A to the transmission block 50 and the reception block 51.

The voltage-controlled oscillator 52A and the branch circuit 52B are mutually connected via the transmission line 53, and the branch circuit 52B is connected to the transmission block 50 and the reception block 51 via the transmission line 53.

The transmission line 53 is provided in each of the divided substrates 45A to 45E and includes a grounded slot line or the like. The transmission line 53 is formed by a band-shaped notch formed in the planar conductor 46 and a high-frequency signal is transmitted in the longitudinal direction thereof.

An undesired-wave propagation preventing circuit 54 is provided on the top surface of each of the divided substrates 45A to 45E. The undesired-wave propagation preventing circuit 54 includes any of the undesired-wave propagation preventing circuits 5, 21, and 31 according to the first to fourth embodiments. Also, as shown with two-dot chained lines in FIG. 21, the undesired-wave propagation preventing circuit 54 is provided around the radiation slot 48A, the resonator 49A, the band-pass filters 50B and 51B, the voltage-controlled oscillator 52A, the transmission line 53, and so forth.

The communication apparatus of this embodiment is configured in the above-described manner. Hereinafter, the operation thereof will be described.

When transmission is performed by using the communication apparatus, a signal of a predetermined frequency, which is a carrier wave, is input to the transmission block 50 by using the oscillation block 52, and also an intermediate-frequency signal IF is input thereto. Accordingly, the transmission block 50 mixes the carrier wave from the oscillator block 52 and the intermediate-frequency signal IF so as to perform up-converting, and the up-converted transmission signal is output to the antenna block 48 via the duplexer block 49. As a result, the antenna block 48 radiates a high-frequency transmission signal through the radiation slot 48A and the transmission signal is externally transmitted through the opening 43A of the cover 43.

On the other hand, when a signal is received by using the communication apparatus, a reception signal received by the antenna block 48 is input to the reception block 51 through the duplexer block 49. At this time, a signal of a predetermined frequency, which is a carrier wave, is input to the reception block 51 by using the oscillator block 52. Accordingly, the reception block 51 mixes the carrier wave from the oscillator block 52 and the reception signal so as to generate an intermediate-frequency signal IF by down-converting.

In this embodiment, the undesired-wave propagation preventing circuit 54 is provided in each of the divided substrates 45A to 45E. With this configuration, an undesired wave which propagates between the planar conductors 46 and 47 of the dielectric substrate 45 can be blocked. Accordingly, an undesired-wave such as a parallel plate mode does not couple among the divided substrates 45A to 45E and isolation can be improved. Also, power loss due to an undesired wave can be suppressed so as to improve efficiency, and noise caused by the undesired wave can be reduced.

Incidentally, the resonators 8, 11, 11', 24, and 34 according to the first to fourth embodiments are formed in a rectangular spiral shape. However, the resonator may be circular or oval spiral shaped.

Also, in the first, third, and fourth embodiments, the undesired-wave propagation preventing circuits 5, 21, and 31 are formed by using a plurality of resonators 8, 24, and 34, in which the resonance frequency is the same. However, the undesired-wave propagation preventing circuit may be formed by using a plurality of resonators in which the resonance frequency is different from each other. Accordingly, the stop band of the undesired-wave propagation preventing circuit can be broadened.

Also, in each of the above-described embodiments, the grounded slot line 4 and the transmission line 53 are used as a circuit for exciting an electromagnetic wave between the planar conductors. However, the circuit may be a PDTL, a transmission line such as a coplanar line, a semiconductor device such as a FET, a resonator, or a filter.

Also, in each of the above-described embodiments, the undesired-wave propagation preventing circuit 5, 21, 31, or 54 is provided on the top surface of the dielectric substrate 1 or 45. However, the undesired-wave propagation preventing circuit may be provided on the bottom surface of the dielectric substrate, or the undesired-wave propagation preventing circuit may be provided on each of the top and bottom surfaces of the dielectric substrate.

Further, in each of the above-described embodiments, the undesired-wave propagation preventing circuit is applied to the high-frequency circuit device having the two planar conductors 2 and 3 or 46 and 47. However, the undesired-wave propagation preventing circuit may be applied to a high-frequency circuit device having three or more planar conductors.

In the fifth embodiment, a communication apparatus is used as a transmitter/receiver. However, the present invention can be widely applied to transmitters/receivers such as radar devices.

What is claimed is:

1. A high-frequency circuit device comprising:

at least two planar conductors which are parallel to each other; and an undesired-wave propagation preventing circuit which is provided in at least one of the two planar conductors and which is coupled with an undesired wave propagating between the two planar conductors so as to block propagation of the undesired wave, wherein the undesired-wave propagation preventing circuit includes multistage band-elimination filters, and the band-elimination filter in each stage includes two conductive lines which are mutually connected at an interstage and a resonator provided at a predetermined portion of at least one of the two conductive lines, said resonator including two spiral lines extending in parallel and forming a spiral shape, ends of the two spiral lines being connected.

2. The high-frequency circuit device according to claim 1, wherein the width of each of the spiral lines is set to the substantially same value along the entire length thereof and the gap between the two spiral lines is set to the substantially same value along the entire length thereof.

3. The high-frequency circuit device according to claim 1, wherein the width of each of the spiral lines is larger at the center of the spiral than at the periphery of the spiral.

4. The high-frequency circuit device according to claim 1, wherein the gap between the two spiral lines is larger at the center of the spiral than at the periphery of the spiral.

5. The high-frequency circuit device according to claim 1, wherein each resonator forming the band-elimination filter of each stage is provided in one of the two conductive lines.

6. The high-frequency circuit device according to claim 1, wherein the resonators forming the band-elimination filters at adjacent stages are arranged at a different conductive line to each other of the two conductive lines.

7. The high-frequency circuit device according to claim 1, wherein each resonator forming the band-elimination filter of each stage is provided in each of the two conductive lines.

8. The high-frequency circuit device according to claim 1, wherein the gap between the two spiral lines is set at 1/10 or less of the distance between the two planar conductors.

9. A transmitter/receiver using the high-frequency circuit device according to claim 1.

10. A high-frequency circuit device comprising:

at least two planar conductors which are parallel to each other; and an undesired-wave propagation preventing circuit which is provided in at least one of the two planar conductors and which is coupled with an undesired wave propagating between the two planar conductors so as to block propagation of the undesired wave, wherein the undesired-wave propagation preventing circuit includes multistage band-elimination filters, and the band-elimination filter in each stage includes two conductive lines which are mutually connected at an interstage and a resonator including a first spiral extending from one of said two conductive lines, and a second spiral extending from an end of the first spiral and being parallel to the first spiral.

11. A high-frequency circuit device according to claim 10, wherein said band-elimination filter at each stage including said two conductive lines and said resonator is connected diagonally to each other.

12. A high-frequency circuit device according to claim 10, wherein said band-elimination filter at each stage includes said resonator provided at each of the two conductive lines, and the respective resonator is arranged alternately from different directions to each other.

13. A high-frequency circuit device according to claim 10, wherein said band-elimination filter at each stage includes said resonator provided at each of the two conductive lines, and the respective resonator is arranged side by side.

* * * * *